US006117272A

United States Patent [19]

Heinzmann

[11] Patent Number: 6,117,272

[45] Date of Patent: Sep. 12, 2000

[54] DEVICE AND PROCESS FOR METERING AUXILIARY MATERIALS INTO THE FLOW BOX OF A PAPER MACHINE

[75] Inventor: Helmut Heinzmann, Böhmenkirch, Germany

[73] Assignee: Voith Sulzer Papiermaschinen, Germany

[21] Appl. No.: 09/146,599

[22] Filed: Sep. 3, 1998

[51] Int. Cl.[7] ..... D21F 1/08

[52] U.S. Cl. ..... 162/216; 162/343; 162/336; 162/258; 162/259; 162/198

[58] Field of Search ..... 162/216, 258, 162/259, 343, 344, 347, 336, 337, 210, 212, 202, 289, 339, 340, 198

[56] References Cited

U.S. PATENT DOCUMENTS

| | | | |
|---|---|---|---|
| 4,888,094 | 12/1989 | Weisshuhn et al. | 162/198 |
| 4,897,158 | 1/1990 | Weisshuhn et al. | 162/259 |
| 5,316,383 | 5/1994 | Begemann et al. | 366/160.1 |
| 5,401,363 | 3/1995 | Begemann et al. | 162/164.6 |
| 5,466,340 | 11/1995 | Begemann et al. | 162/216 |
| 5,549,793 | 8/1996 | Hellstrom et al. | 162/258 |
| 5,603,806 | 2/1997 | Kerttula | 162/198 |
| 5,885,420 | 3/1999 | Heinzmann et al. | 162/198 |

FOREIGN PATENT DOCUMENTS

| | | |
|---|---|---|
| 0824157 | 2/1998 | European Pat. Off. . |
| 43 20 243 | 12/1994 | Germany . |
| 98/23812 | 6/1998 | WIPO . |

*Primary Examiner*—Stanley S. Silverman
*Attorney, Agent, or Firm*—Ostrolenk, Faber, Gerb & Soffen, LLP

[57] ABSTRACT

A headbox for a paper machine which mixes suspension and additives to achieve a selected basis weight cross direction profile and fiber orientation cross direction profile in paper produced from the machine. The headbox has sections across its width. Each section is supplied with a first stream $Q_H$ of one suspension component, a second stream $Q_L$ of a second suspension component. A valve regulates the total suspension flow $Q_M$ as well as the ratio between the first and second streams. An additive stream $Q_{ad}$ for each section communicates into the combined suspension flow. A valve regulates the additive stream for achieving the selected profiles. Various places along the suspension flow path are indicated as inlets for the additive stream. The headbox has a microturbulence generator for generating turbulence in the suspension passing through it. There may be lamellae within the headbox which somewhat separate the entry flow into the headbox. That version of the headbox has separated entrance flows with different additives at different layers. The invention further concerns a method of use of the headbox which results from the structure described above.

49 Claims, 15 Drawing Sheets

FIG. 19c
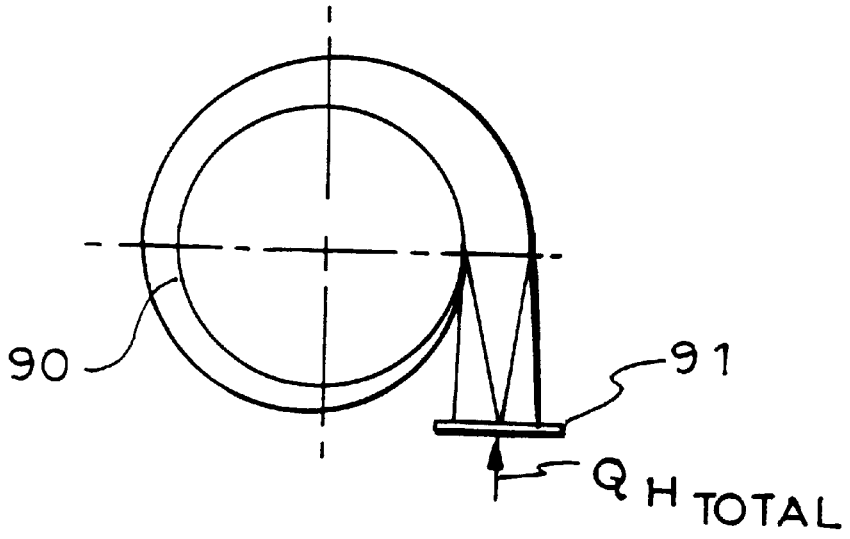
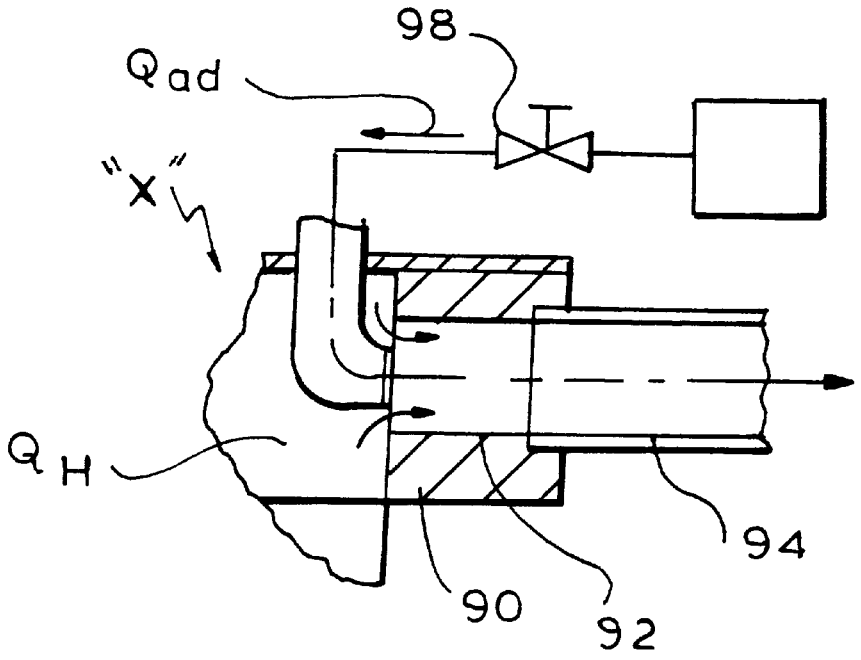
FIG. 19d

DEVICE AND PROCESS FOR METERING AUXILIARY MATERIALS INTO THE FLOW BOX OF A PAPER MACHINE

BACKGROUND OF THE INVENTION

The invention relates to a headbox of a paper machine for producing paper, board, tissue etc., and particularly relates to a process for interference free charging of the headbox with paper stock suspension and auxiliary materials.

Headboxes in paper machines receive paper stock suspension, which is fed to them through a pipeline, distribute the suspension uniformly over the headbox width and discharge the distributed suspension onto a dewatering wire of a Fourdriniere wire or hybrid former, or onto two dewatering wires of a double-wire former, in the form of a machine-width jet. The uniformity of the distributed suspension relates both to the mass distribution of the solids contained in the suspension over the stock jet width across the width of the headbox and over the stock jet height and also to the velocity distribution of the suspension over the width of the stock jet. As to the latter factor, a localized change in suspension velocity at a width location could locally affect the fiber orientation in the paper produced in the machine particularly along the interfaces in the web of paper between the localized region where the suspension had changed velocity and adjacent regions where the suspension had not similarly changed velocity.

If the foregoing distribution tasks are not fulfilled, then the paper quality, such as the mass per unit area distribution over the web width, that is, the mass per unit area transverse profile and/or a pre-set fiber orientation transverse profile, are disturbed.

In order to fulfill the distribution tasks, headboxes have various flow sections. The suspension is fed from a pipeline to a transverse distribution pipe that runs over the width of the headbox. This pipe has a flow cross section that decreases in the flow direction of the pipe across the width of the headbox in order to even out and control the suspension over the width. For example, the velocity and force of the suspension being fed from the pipe into the headbox may be made uniform across the width.

The transverse distribution pipe is joined to one or two guide devices within the headbox and the pipe, and the guide devices are typically separated by an intermediate channel or chamber from the distribution pipe. The guide devices generate turbulence, align the flow and provide uniform outflow from the downstream nozzle which follows the guide devices. The nozzle tapers narrower in the flow direction. The downstream end of the headbox has a machine width nozzle gap, from which the stock jet emerges in the direction of the web former.

Even with an optimal headbox configuration, interfering variables act on the paper manufacturing process and disturb the mass per unit area distribution, for example. Many headboxes therefore have a slice at the nozzle gap, which enables local setting of the gap width, which here means the local height of the outlet opening, in order to correct the mass per unit area over the paper web width.

DE 40 19 593 A1, which corresponds to U.S. application Ser. No. 08/662,980, incorporated herein by reference, discloses a new headbox principle in which the correction of the mass per unit area distribution in the paper produced by the machine including the headbox is carried out by locally changing the consistency of the pulp suspension at locations in the headbox. In this case, the feed to the headbox, viewed over the width of the headbox, is formed by a large number of separate channels, so called sections. A suspension mixer is connected upstream of each section. Two partial flows are fed to each mixer where they are mixed to form a mixed volume flow or section volume flow. The first partial flow is comprised of paper stock suspension having a solids concentration $C_H$. The second partial flow is comprised of water, or preferably wire water or white water from the paper manufacturing process, having a solids concentration $C_L$, wherein the concentration $C_L$ is smaller than the concentration $C_H$. The arrangement enables the mixture ratio of the two partial flows to be set in a deliberate manner, without changing the total, combined sectional mixed volume flow at each section, i.e., without changing the velocity of flow at each section. This has the advantage that the fiber orientation transverse profile of the paper produced is set in the particular section or being set in adjacent sections is not impaired by a local area flow velocity change during the local correction of weight per unit area.

As a result of the development of these so-called dilution water headboxes, it has been possible to improve paper quality significantly, in terms of the quality of the mass per unit area transverse profile and the fiber orientation transverse profile. However, increasing paper machine operating speeds make it more difficult to achieve constant, respectively desired conditions for good paper quality in the paper manufacturing process. Interfering influences become larger. At the same time, the requirements of the converter as to various paper properties, such as printability, strength relationships and optical properties, are increasing. Defined properties over the paper web width and paper web thickness are particularly important.

In the forming area of the machine, small differences in the condition of the wires and of the dewatering elements have an increasing interference effect over the width at increasing paper machine speeds. This can produce differences in the dewatering and thus in the retention of the various solids materials contained in the paper suspension over the width, and can thus produce a different composition of the finished paper web. This leads to a streaky distribution of the paper properties over the web width.

EP Publication 0 651 092 A1 discloses a multilayer headbox for deliberately influencing the distribution of fillers and chemicals over the paper thickness, that is over several layers in the z-direction. Each layer has its own feed which passes separately from the other layers within the headbox. Metering points for chemicals and fillers are provided in the respective feeds. This enables manufacture of papers with different compositions over several layers in the z-direction.

However, this solution is very complicated, as compared with a single layer headbox, because separating lamellae are required in the nozzle and because at least three feed systems are used, i.e., usually one for each layer. A further disadvantage is that the auxiliary material or fillers and chemicals distribution can be influenced only in the z-direction and not in the transverse or width direction, i.e., the y-direction.

Thus, streaks occurring over the width cannot be prevented.

U.S. Pat. No. 5,560,807 discloses a headbox in which it is possible to influence the fillers and chemicals distributions in both the z- and the y-directions. In this case, the metering lines for auxiliary materials open into the transverse distributor in rows between the pipe openings of the pipes of the guide device. The direction of the metered flows is counter to the machine running direction and is at 90° to the feed direction of the main flow in the transverse distributor pipe. A metered flow is therefore intended to be carried downstream by the main flow and to be carried by the main flow into the adjacent pipe of the guide device, for example, to influence the filler content at the point in the paper that aligns with the corresponding pipe.

The inflow from the metering lines to the distribution pipe has a disadvantageous effect in this arrangement. For example, if it is intended to correct the filler transverse profile, then the appropriate quantity of filler must be brought to the correct point along the y-direction. If the amount of filler, that is, the metering volume flow, is increased, then the inflow velocity of the filler necessarily increases. The metering stream penetrates more deeply into the main flow and is consequently swept further downstream along the path of the main flow. As the metered amount increases, this presents a risk that filler will be supplied, not to the adjacent pipe of the guide device as intended, but instead to the next further away pipe. This would influence the suspension at the wrong point across the headbox and would worsen the filler profile in the y-direction of the paper produced.

A paper grade change presents a particular problem for maintaining a predetermined profile, since it is often accompanied by a change of the overall flow volume. Values from experience show that the ratio between the maximum and minimum throughput may be 2 to 3. This means that the velocity in the transverse flow distributor for paper grade A may be three times the velocity for grade B. This likewise leads to the above described dragging of the metered substances in the y-direction.

A further solution for metering additives into a headbox is proposed in German application 196 32 673.7, dated Aug. 14, 1996. Metering, for example, is done in the area of the transverse distribution pipe, or in the pipes of the guide device or in the outlet nozzle. The disadvantages described above also occur with these solutions. In addition, metering into the pipes of the guide device is very complicated in terms of production, particularly where there are a large number of rows of pipes, which are often offset in relation to each other. Further, metering is barely possible because of the small size of the metering pipe cross sections. Metering the additives into the nozzle space in this manner can lead to streak formation of the additives, since no guide device with significant mixing turbulence follows. A further disadvantage resides in the risk of fiber string formation at the lance like metering pipes, which penetrate at right angles to the main flow.

SUMMARY OF THE INVENTION

The object of the invention is to provide improved, more cost effective solutions for metering additives, like fillers and chemicals, e.g., emollients, retention aids, chemicals for increasing or decreasing the dewatering velocity, into headboxes, to deliberately influence the paper quality and paper composition over the web width and web thickness, without impairing other quality features, such as the mass per unit area transverse profile and/or the fiber orientation transverse profile, and without interfering with the paper manufacturing process.

In the invention, at least one additive is metered into or shortly upstream of a mixing zone of the paper stock suspension which is upstream of the microturbulence generator in the headbox. The mixing zone preferably lies in the area of or upstream of a vortex generation zone, to ensure uniform mixing. The at least one additive is metered in at various sections of the headbox over the y-direction or width and, optionally, also over the z-direction or height, into the dilution water headbox. The flow direction of the paper stock suspension at the mixing zone is free of a y-direction velocity component.

The at least one additive is added, upstream of the microturbulence generator, either to one of the section partial flows $Q_L$ and/or $Q_H$ before they are combined into a flow $Q_M$ or to the combined section flow $Q_M$ after the partial flows are combined.

A precondition for achieving the object is the presence of a headbox that is subdivided into sections over the width of the headbox. Each section has a mixer to which two flows of liquid are introduced. At least one flow is a pulp suspension or stock flow. In particular the mixer receives partial stock flows Q and $Q_H$ of different consistencies are fed.

Each section has at least one connection for feeding at least one controllable partial additive stream at any desired point along the flow path through the section, but preferably upstream of the entry of the stock suspension into the microturbulence generator in the headbox. In particular, entry is preferably into a mixing zone, e.g. near a sudden expansion of the flow channel of the partial stock flow or near a throttling device, whereby the main flow direction of the partial stock flow is free of a y-direction component. For example, this connection may be upstream of the mixer at one of the partial stock flow lines, or directly into the mixer, or downstream of the mixer into the section flow line coming directly from the mixer, or into a machine width intermediate channel inside the headbox but before the microturbulence generator, and so on.

In some embodiments, the correction may alternatively be downstream of the microturbulence generator. But then it is near the downstream end of the microturbulence generator to utilize the mixing effect of the turbulence produced in the microturbulence generator. This arrangement is advantageous if a two or three layer additive distribution in the z-direction of the paper produced is desired. The distance of the metering point to the downstream end of the turbulence generator should be at a maximum as great as the mixing effect has a width, which is about equal to the width of one section. This assure a smooth transition of the additive distribution between two neighboring sections. The supplies of each stream of pulp suspension and additive to all sections is preferably through a respective common supply for each suspension stream and additive stream. The supply of each stream to each section branches off from the respective common supplies. The valve V1 for controlling the flow rate of the suspension component to each section and the valve V2 for controlling the flow rate of additive to each section are independently controlled. Valves V1 are the actuators for adjusting the basis weight cross profile and valves V2 adjust the additives cross profile, respectively, for adjusting the distribution in z-direction. The actual cross profiles are measured either on line or off line in the produced paper for basis weight and for each of the relevant additives. If there is a difference from the desired cross profiles, the process controlling system gives a new set point for the respective valves V1 and/or V2 in order to minimize the difference between the actual and the desired "quality" cross profile in the paper, in each section.

The invention achieves complete mixing of the at least one additive with the paper stock suspension over the respective section width within each section. Thus, no streaks should occur in the stock composition of the paper in the y-direction. Furthermore, dragging or shifting of the additive flows in the y-direction is avoided by the flow of the paper stock suspension and/or by the metered flow having no transverse y-direction component in the area of the mixing zone of paper stock suspension and additive.

As a result, irrespective of the operating conditions of the headbox, such as the headbox throughput or the volume flows of the metered flows for the at least one additive, the transverse profile of the paper web composition can be set in a deliberate manner. Hence, the paper properties can be influenced in a deliberate manner at any point along the y-direction and/or the z-direction.

Furthermore, the process according to the invention and the configuration of the dilution headbox according to the invention can be implemented in a cost effective manner, since the lines of the section flows or section partial flows are easily accessible for the connection of the metering lines.

It is possible to reequip headboxes with the system according to the invention, without having to undertake expensive changes at the nozzle or of the microturbulence generator insert. The necessary simple parts can be prepared independently of the operation of the paper machine and can be installed during a short paper machine stop.

A further advantage of the invention is that no interfering installed fittings, such as lance like metering pipes, open into the flow channels. A build-up of the fibers and the formation of fibrous lumps are avoided, which prevents expensive paper web breaks during paper production. The operational reliability and runnability of the paper machine are thus not impaired by metering the additives according to the invention, which provides considerable economic advantages for the paper manufacturer, in contrast with the prior art solutions described above.

Other features and advantages of the present invention will become apparent from the following description of the invention which refers to the accompanying drawings.

BRIEF DESCRIPTION OF THE DRAWINGS

FIG. 19*c* is a bottom view of the central distributor;

FIG. 19*d* is a schematic fragmentary view at X in FIG. 19*b* showing one of the suspension mixture and metering connections within the distributor;

DESCRIPTION OF BACKGROUND EMBODIMENTS

Figure 1:
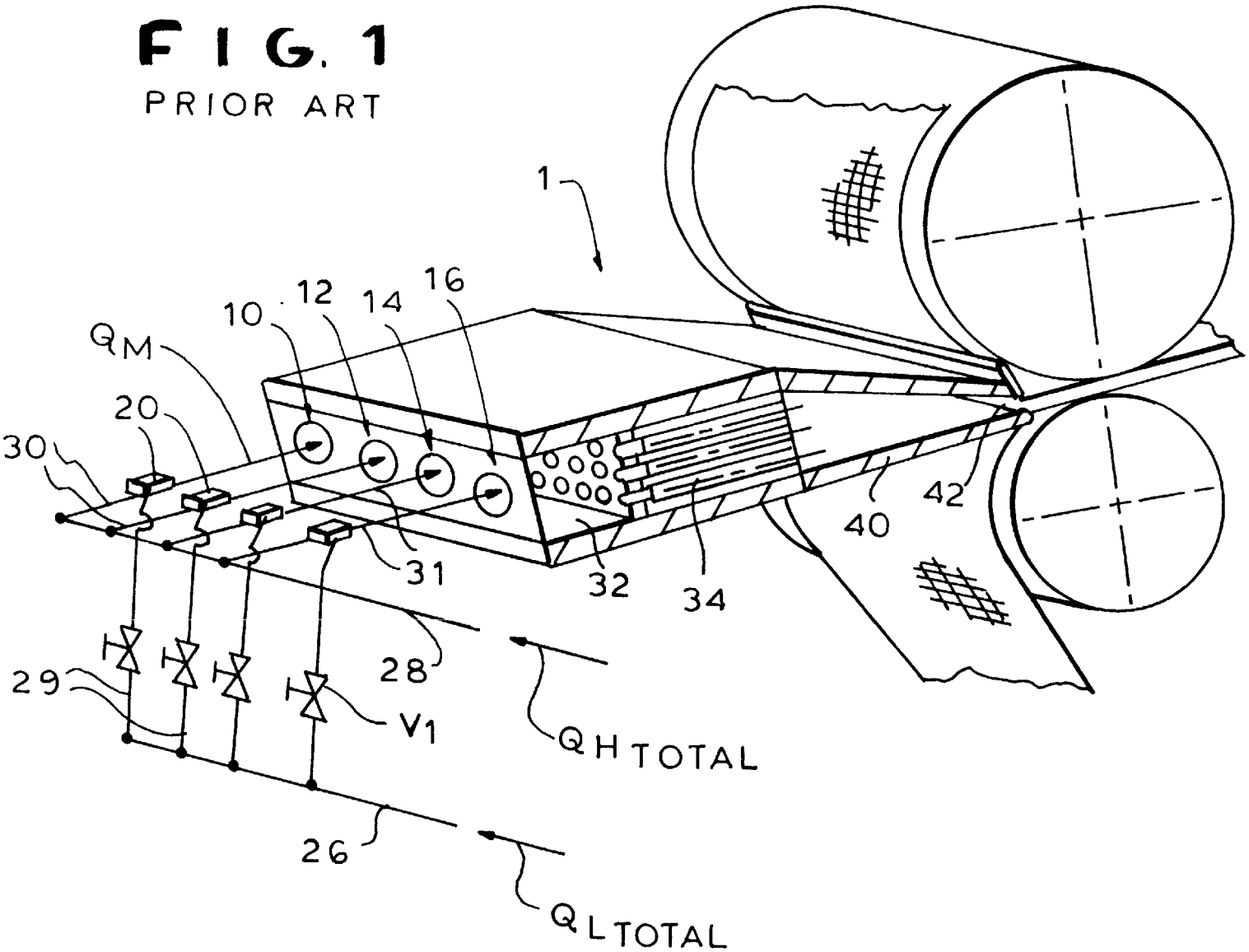
FIG. 1 PRIOR ART
FIG. 1 is a schematic perspective view of a headbox in the prior art for which the present invention provides an improvement.

FIG. 1 shows a prior art dilution water headbox 1 in combination with a twin-wire gap former 2 of a type known in the art. This headbox is adapted with embodiments of the invention in subsequent Figures. The suspension is fed to the headbox through a plurality of headbox sections 10, 12, 14, 16, etc. In this example, each section has a respective mixer 20, which mixes at least two suspensions ($Q_H$, $Q_L$) of respective and usually different consistencies ($C_H$, $C_L$) in such a way that the mixed volume flow $Q_M$ and therefore the flow velocity in a respective section remains constant, even when the mixture ratio $Q_L/Q_H$ at the section changes in order to adjust the basis weight cross profile. For example, for each section across the width, a valve V1 is placed in is each line 29 communicating between a line 26 for suspension $Q_L$ and respective mixer 20 for that section.

Constant flow volume is achieved by valves placed in one or more of various approach lines or distributors, e.g. 26 or 28, and operated for maintaining a ratio of $Q_{LTOTAL}$ to $Q_{HTOTAL}$, whereby $Q_{LTOTAL}$ and $Q_{HTOTAL}$ are constant during production of a paper grade.

Figure 19A:
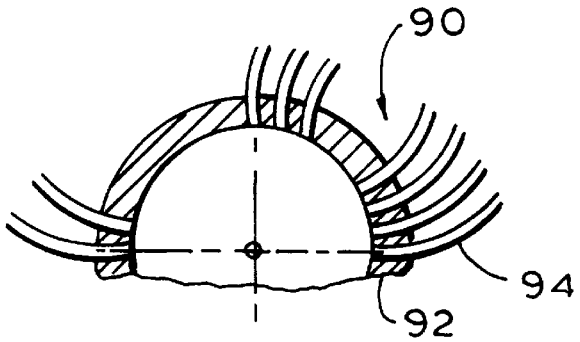
FIG. 19*a* is a schematic top view of an alternate central distributor for suspension for use in connection with any of the headbox embodiments.
Figure 19B:
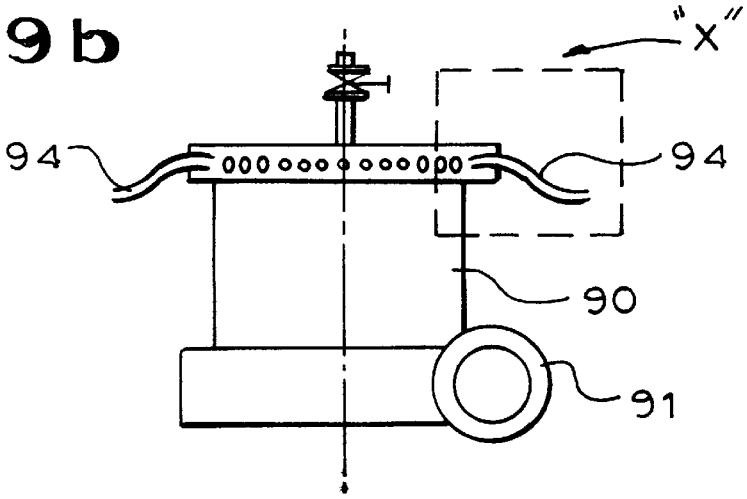
FIG. 19*b* is a elevational view of the distributor of FIG. 19*a;*

The partial flows $Q_{LTOTAL}$ e.g., water, wire water, and $Q_{HTOTAL}$ e.g. concentrated suspension, are fed to the appropriate sections by transverse distribution pipes 26 for $Q_L$ and 28 for $Q_H$ (see also FIG. 2*a*) and/or by central distributors (see FIG. 19). The sectional flow $Q_L$ from pipe 26 passes through section pipe 29 to section mixer 20. The sectional flow $Q_H$ from pipe 28 passes through section pipe 30 into section mixer 20.

Figure 1A:
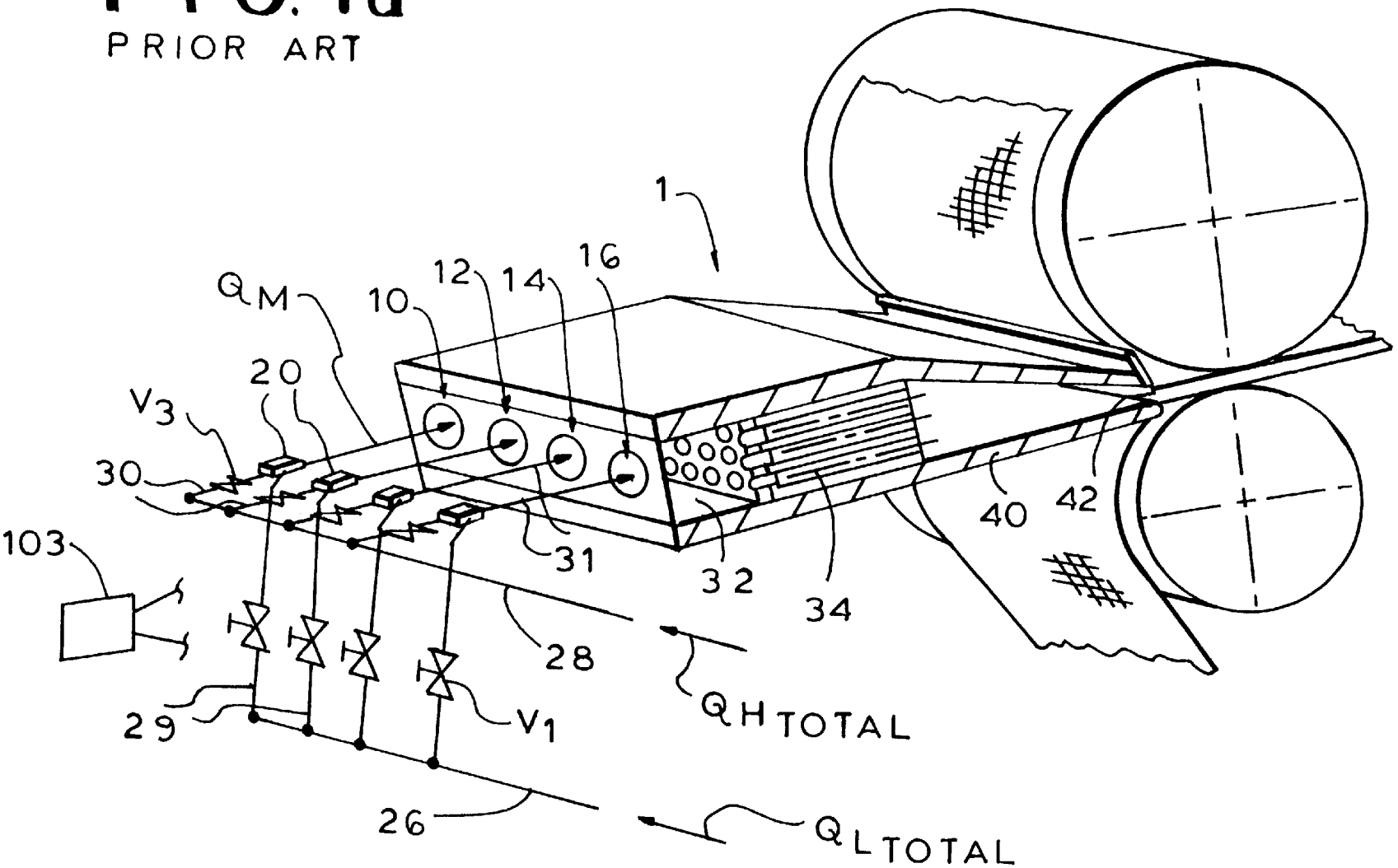
FIG. 1a PRIOR ART
FIG. 1*a* is the same type of view as FIG. 1, with an additional valve.

With reference to prior art FIG. 1*a,* an additional valve V3 is shown in line 30, between approach pipe 28 and each mixer 20. To maintain the flow volume $Q_M$ in the respective section constant, while the mixture ratio $Q_L/Q_H$ is adjusted, the valves V1 and V3 are commonly controlled by controller 103 connected to each valve V1 and V3 so that $Q_M$ at each section across the width remains constant, e.g. if a greater mixture ratio is desired, the valve V1 is opened and simultaneously the valve V3 is closed, so that the changed, e.g. increased, flow rate $\Delta Q_L$ in one suspension component is equal to the decreased flow rate $\Delta Q_H$ in the other suspension component. (For example, if $Q_L$ is increased by about 10 l/min., $Q_H$ should be decreased also by about 10 l/min.). From the mixers 20, the section lines 31 with the mixed volume flows $Q_M$ open into the headbox 1.

Another possibility to maintain the flow volume $Q_M$ in the respective section constant is to use a mixer arrangement described in U.S. Pat. No. 5,316,383. This arrangement shows FIG. 1 hereof. Only one valve V1 is necessary. If the sectional flow $Q_L$ is increased by means of valve V1, $Q_H$ is decreased by the same amount of flow rate. This is due to the angle a between the $Q_H$-line and the $Q_L$-line at the metering point.

The headbox 1 illustrated has an intermediate channel(s) or chamber(s) 32. The channel 32 may be open across the width of the headbox, as suggested in FIG. 1, or may have partitions 36, e.g., of the type shown in FIG. 17 between adjacent sections 10, 12, etc. The partitions 36 may extend downstream as far as the microturbulence generator 34 (FIG. 17) or may terminate spaced at a distance from the microturbulence generator (FIG. 18).

The microturbulence generator 34 adjoins and follows the intermediate channel 32 in the headbox. That generator may, as illustrated, comprise a large number of pipes or else may comprise square or rectangular channels that are formed by plates.

A convergent or tapering nozzle 40 is downstream of and adjoins the outlet side of the microturbulence generator 34. The nozzle 40 ends at an outlet gap, slot or slice 42. The suspension jet emerges from the gap 42 and is fed to the following dewatering and forming unit 2 of the paper machine.

A single layer headbox 1 is illustrated in nearly all of the embodiments. This means that the composition of the suspension in the headbox is constant in the z-direction, i.e., thickness or height. In all of the embodiments, the additives must be metered such that the sectional mixed volume flow $Q_M$ is not influenced and remains at a selected volume and flow per unit of time or velocity or there may be disruption in the desired fiber orientation or solids concentration profile across the web. As one component flow volume is changed at one section, the flow volume of other flow components of that section must be adjusted to retain $Q_M$ constant.

DESCRIPTION OF PREFERRED EMBODIMENTS

The following Figures show possible exemplary embodiments of the invention which may be associated with or added to the prior art headboxes in either of FIG. 1 or 1*a* to produce the embodiments in the subsequent Figures. Corresponding reference numbers are used for corresponding elements and descriptions of elements provided for an embodiment are not repeated for subsequently described embodiments.

Figure 2:
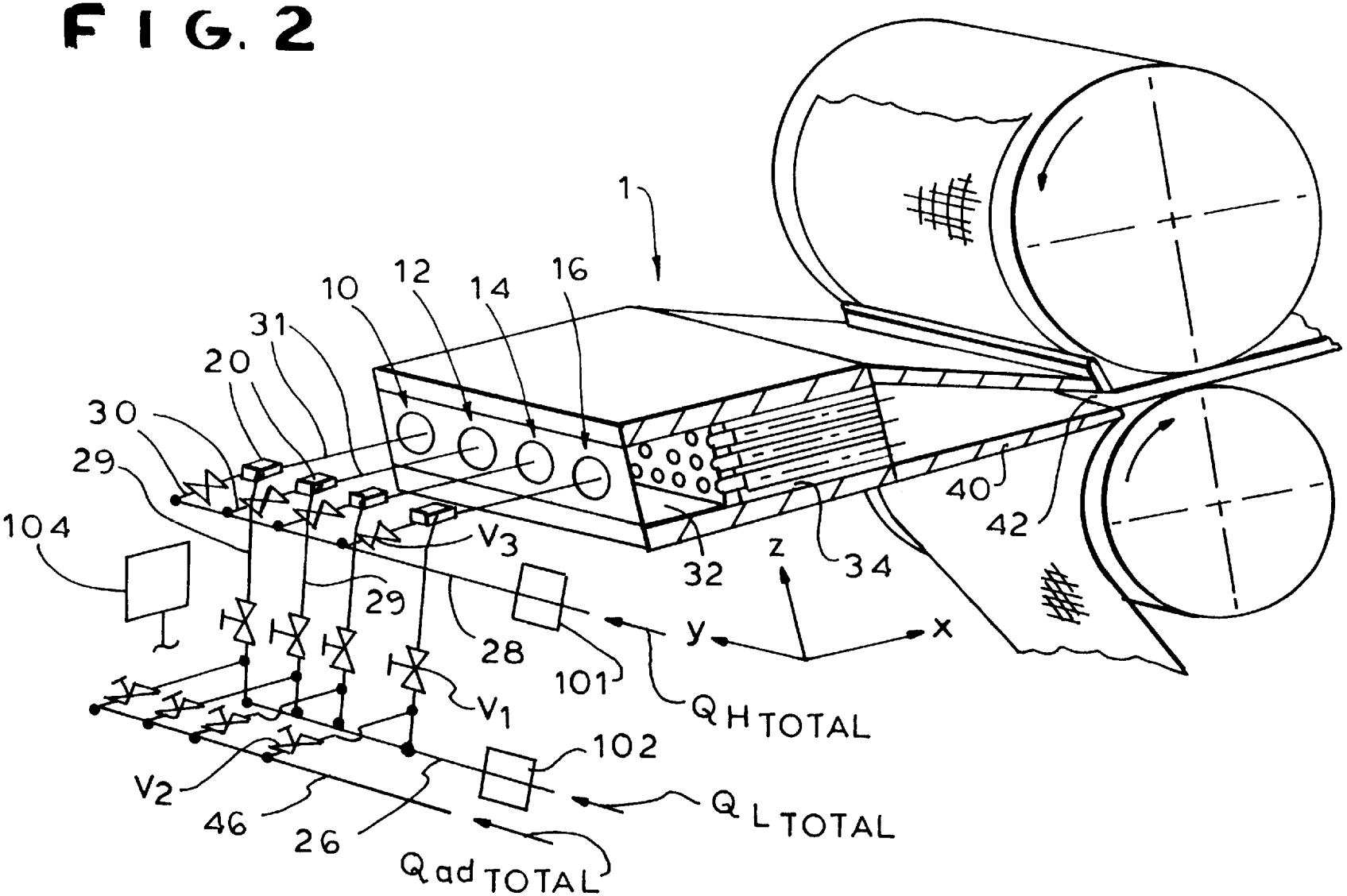
FIG. 2 is the same type of view of a headbox as shown in FIG. 1 and including the additive supply according to an embodiment of the invention.

FIG. 2 shows a first embodiment for metering additives into the sectional partial flows $Q_L$ in section pipes 29 upstream of the respective first valves V1. The headbox and the elements leading into it and the forming section following the headbox in FIG. 2 are the same as in FIG. 1.

Figure 3:
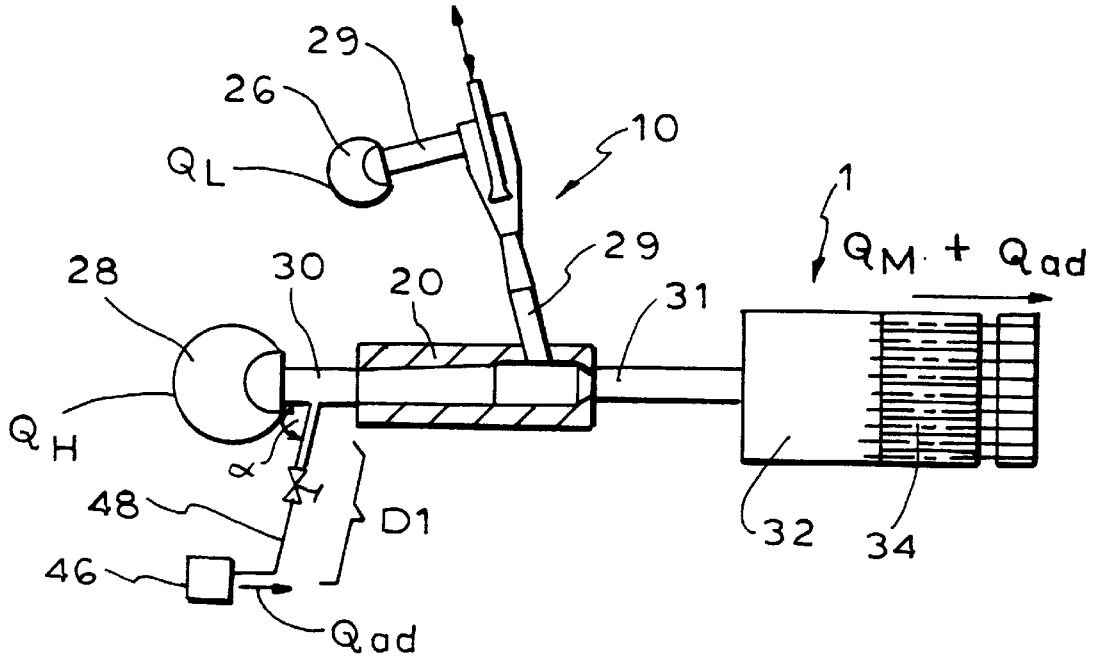
FIG. 3 is a view of the same type as FIG. 2*a* illustrating a second embodiment of the invention.
Figure 4:
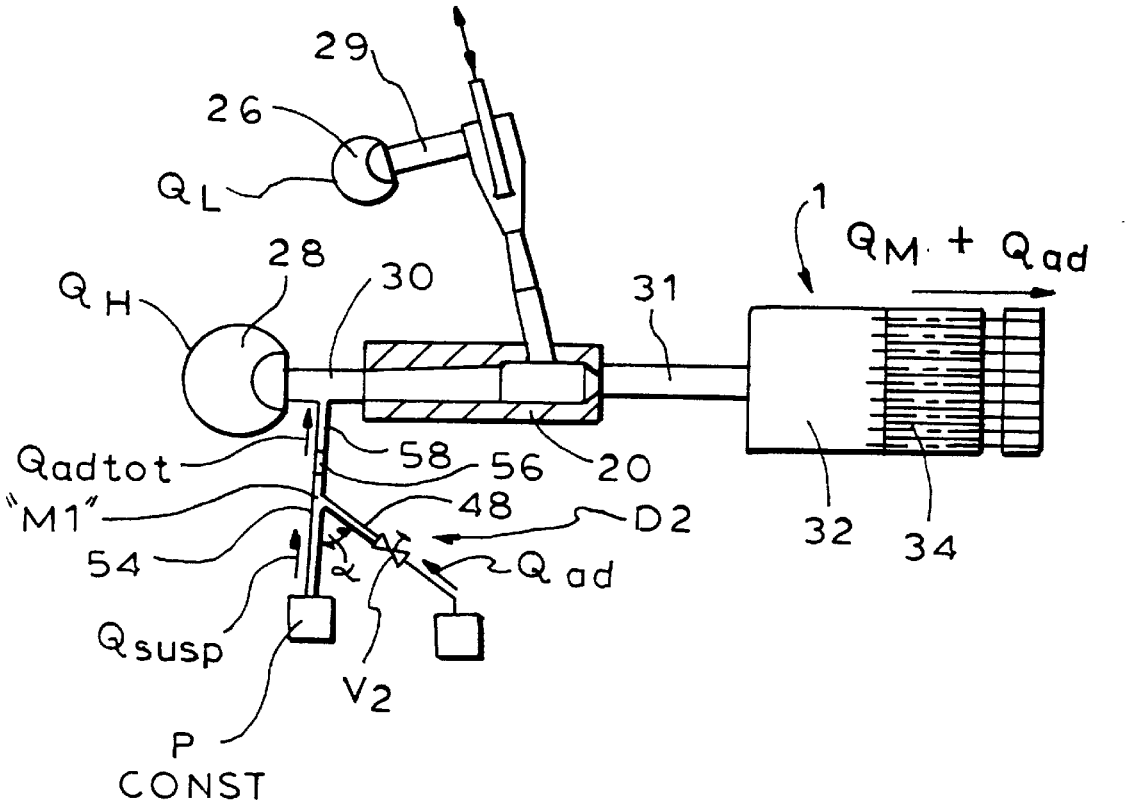
FIG. 4 is a view of the same type as FIG. 2*a* illustrating a third embodiment of the invention.

The additional elements shown in FIG. 2 concern addition of additives. The additives may comprise one or more of fillers, emollients, chemicals for influencing the dewatering behavior of the pulp in the forming section, e.g. increasing or decreasing the dewatering velocity in order to obtain optimal paper quality cross profiles, or other types of additives typically supplied to paper stock suspension to be mixed with the suspension before distribution by the headbox. A metered flow of the additives $Q_{ad}$ for all of the sections 10, 12, 14 et al. is likewise supplied by means of transverse distribution pipe 46, central distributors (FIG. 19) or supply containers, using hoses or pipes, for example. The common flow through pipe or line 46 for $Q_{abTOTAL}$ is selectively diverted through a respective pipe or line 48 at each section which communicates into the respective pipe 29 for each section which supplies the partial stream $Q_L$ to the mixer 20 for that section. Therefore, additives are added to the respective stream $Q_L$ to each section upstream of the respective valve V1 for that section. The second valve $V_2$ in each pipe 48 regulates the volume of additives per unit time in each sectional stream $Q_L$. As the mixed materials flow rate $Q_M$ has to be constant while setting $Q_{ad}$, a special metering arrangement is needed. FIG. 3 and FIG. 4, described in detail below, demonstrate two possibilities, metering of additives in sectional partial flows $Q_H$, for example.

As illustrated in FIG. 2, the pipe 48 communicates with the pipe 29 upstream of the first valve V1, whereby the valve V1 regulates the total mixed flow of $Q_{ad}$ and $Q_L$ to a regulated volume in order to adjust the basis weight in the paper web in the respective positions over the width of the paper web corresponding to the sections across the headbox. The ratio of the flow $Q_{ad}$ to the flow $Q_L$ in a particular section is therefore regulated by the valve V2. That metered volume flow is fed to the sectional partial flow $Q_L$ upstream of the valve V1. Therefore, the additive concentration in the respective section can be changed, whereby the additive distribution over the width of the paper web can be adjusted by the valves V2 sectionally across the headbox.

Because the flows though all sections should be coordinated in order to achieve desired profiles across the suspension and the web produced therefrom, all valves V1, and/or V2 and/or V3 may be connected to a common coordinating control unit 104 or to an individual control unit for one or for several valves which either senses or is supplied with information as to the status of each profile of the suspension and/or of the paper produced and adjusts individual valves to set the desired profiles across the width of the web.

Figure 2A:
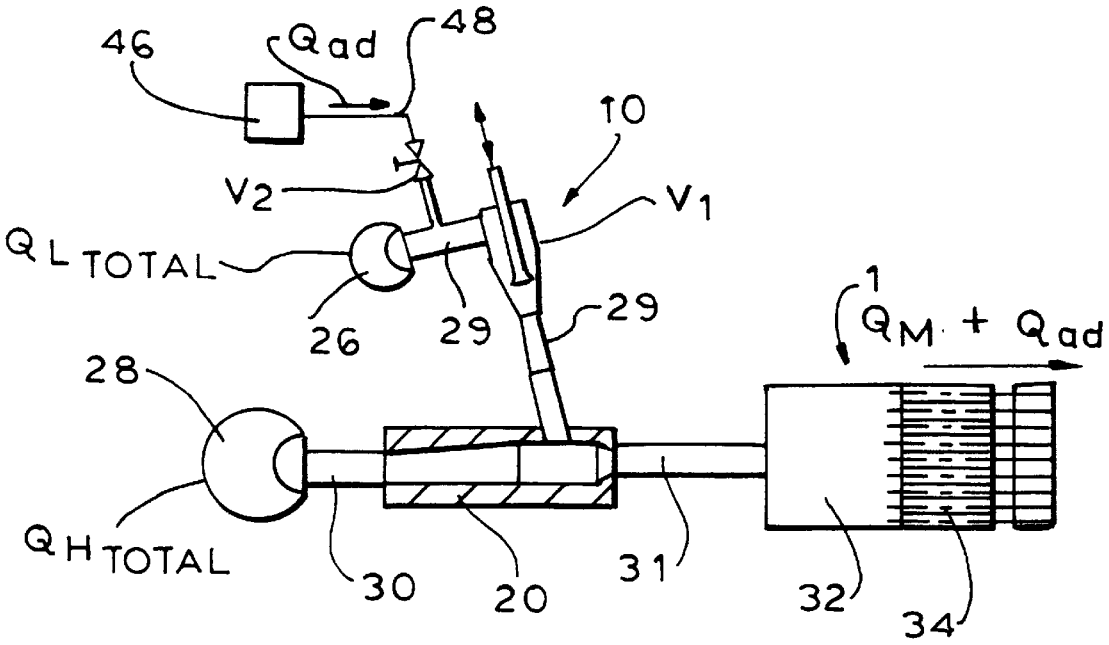
FIG. 2*a* is a schematic lateral cross-sectional view of a portion of the headbox and inlets thereto illustrating a first embodiment of the invention.

FIG. 2*a* shows, an exemplary construction of the section, e.g., 10, corresponding generally to FIG. 2 and in a vertical longitudinal section. Although the orientation and lengths of elements in FIG. 2*a* is inconsistent with that in FIG. 2, the operative connections between elements are the same and the positions and functions of valves and the like are the same for illustrative purposes.

FIG. 2*a* shows a particularly advantageous embodiment, since the metering point at V2 is followed by the line 29 and the valve V1. Thus, the additive flow $Q_{ad}$ is mixed homogeneously with the section partial flow $Q_L$ in the region of the throttling point with the valve V1 (vortex generation). It is also advantageous that any influence upon the sectional partial volume flow $Q_L$ due to the additive flows $Q_{ad}$ can be compensated at valve V2. As a result, the basis weight at the respective section in the paper web is not disturbed. Also, the sectional mixed flow $Q_M+Q_{ad}$ in line 31 remains constant, due to the special arrangement of pipe 29 in respect to line 30 (angle a described in U.S. Pat. No. 5,316,383). As a result, the metering line or pipe 48 can open into the section line or pipe 29 at any desired angle, and preferably does so at 90°.

Whereas in FIGS. 2 and 2*a* the additives are metered into the partial flow $Q_L$, in the embodiment of FIG. 3, the additives are metered into the sectional partial flow $Q_H$ in the line 30. The metering device $D_1$ is located downstream in the section pipe 48 from the distribution pipe 46 and upstream of the mixer 20.

In order that the partial sectional volume flow ($Q_H$+$Q_{ad}$) will always remains constant during metering, the metering angle α between the additive pipe 48 and the section pipe 30 and after the metering device D1 should be less than 90° and greater than 45°, in order that $Q_{tot}$ out the headbox 1 not be impaired. This metering device D1 and its entrance into the section line 30 is repeated in several of the embodiments.

The embodiment of FIG. 4 is similar to that of FIG. 3 in its placement of the entrance of the additive line 58 to the section line 30. The metering device D2 in FIG. 4 retains $Q_{adtot}$ constant during the metering of $Q_{ad}$ by operation of the valve $V_2$. Here, the valve regulated additives $Q_{ad}$ are first mixed with a further volume suspension flow $Q_{susp}$ before entering into the sectional partial volume flow $Q_H$. The pipes 48 for $Q_{ad}$ and 54 for $Q_{susp}$ are joined together and meet at an angle α (45° . . . <90°) at the mixing point M1 such that $Q_{adtot}$=$Q_{ad}$+$Q_{susp}$ remains constant. Advantageously, the mixing point M1 is followed in the flow direction by a throttle 56 which is located in the mix pipe 58. The metered flow $Q_{adtot}$ in the mix pipe 58 can therefore be metered into the sectional partial flow $Q_H$ in the pipe 30 and upstream of the mixer at any desired angle, and preferably 90°. The metering device D2 and its entrance into the section line 30 is repeated in several of the embodiments.

Figure 5:
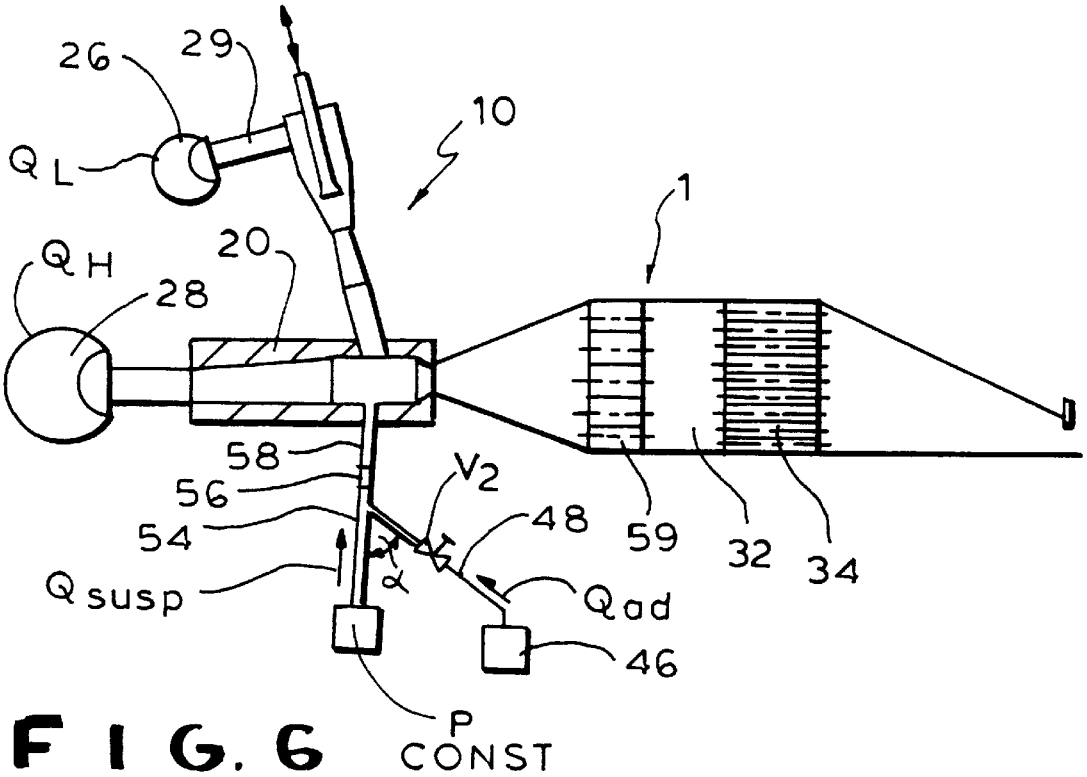
FIG. 5 is a view of the same type as FIG. 2*a* illustrating a fourth embodiment of the invention.

FIG. 5 is similar to FIG. 4 in mixing $Q_{ad}$ with $Q_{susp}$ in a pipe 58. The pipes 48 for additives and 54 for suspension meet at a similar angle as in FIG. 4. The metering of $Q_{ad}$ takes place at valve $V_2$. For FIG. 5, $Q_{adtot}$ does not enter the section line pipe 30 or the main flow suspension distributing pipe 28 but instead directly enters the mixer 20 at the bottom side and opposed to the flow $Q_L$ from pipe 29 and valve V1, which enters at the top, thereby providing a mixing zone in the mixer 20. In the embodiment of FIG. 5, in contrast to FIG. 4, the pipe 58 enters the mixer 20 rather than entering the section pipe 30, causing initial mixing of $Q_{ad}$ in the mixer 20, not in the pipe 30. There is sufficient mixing and turbulence in the mixer 20 for further processing of the suspension in the headbox.

The headbox 1 in the FIG. 5 embodiment has two tube bundles 34 and 59 spaced apart in the flow direction for creating turbulence in the headbox. The upstream bundle or turbulence generator 59 has larger cross section openings than the downstream microturbulence generator 34.

Figure 6:
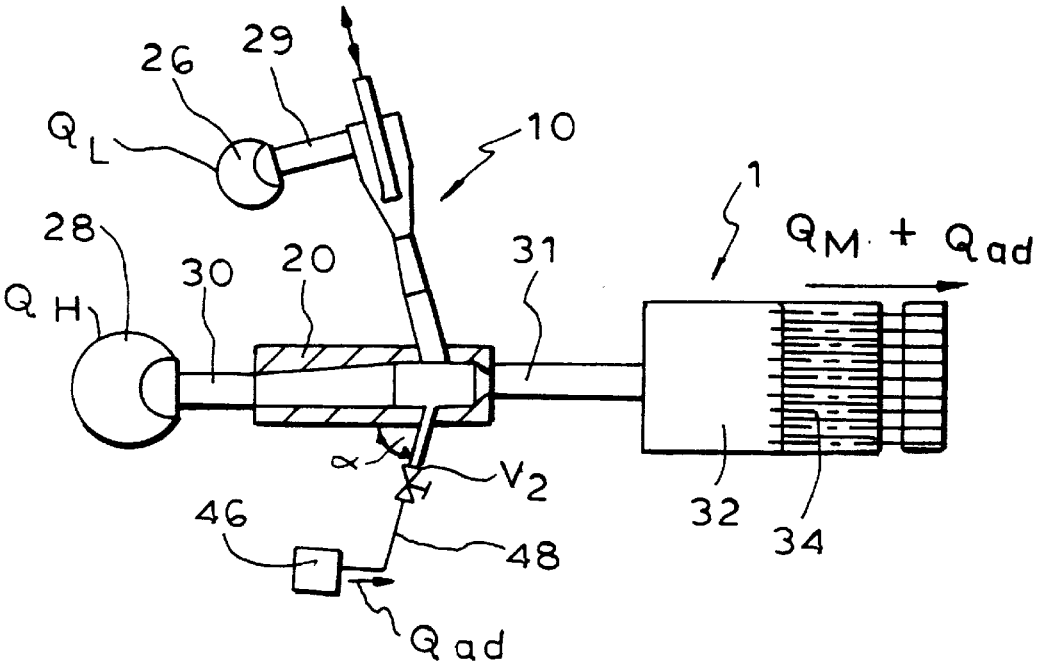
FIG. 6 is a view of the same type as FIG. 2*a* illustrating a fifth embodiment of the invention.

The embodiment of FIG. 6 is mostly equivalent to the embodiment of FIG. 3. However, the section pipe 48 from the distribution pipe 46 supplying additives does not meet the section pipe 30 directly, but instead enters the mixer 20 at an angle α, which angle is similar to that angle in FIG. 3. In FIG. 6, corresponding to FIG. 5, the pipe 48 enters the mixer 20, not the sectional pipe 30.

Figure 7:
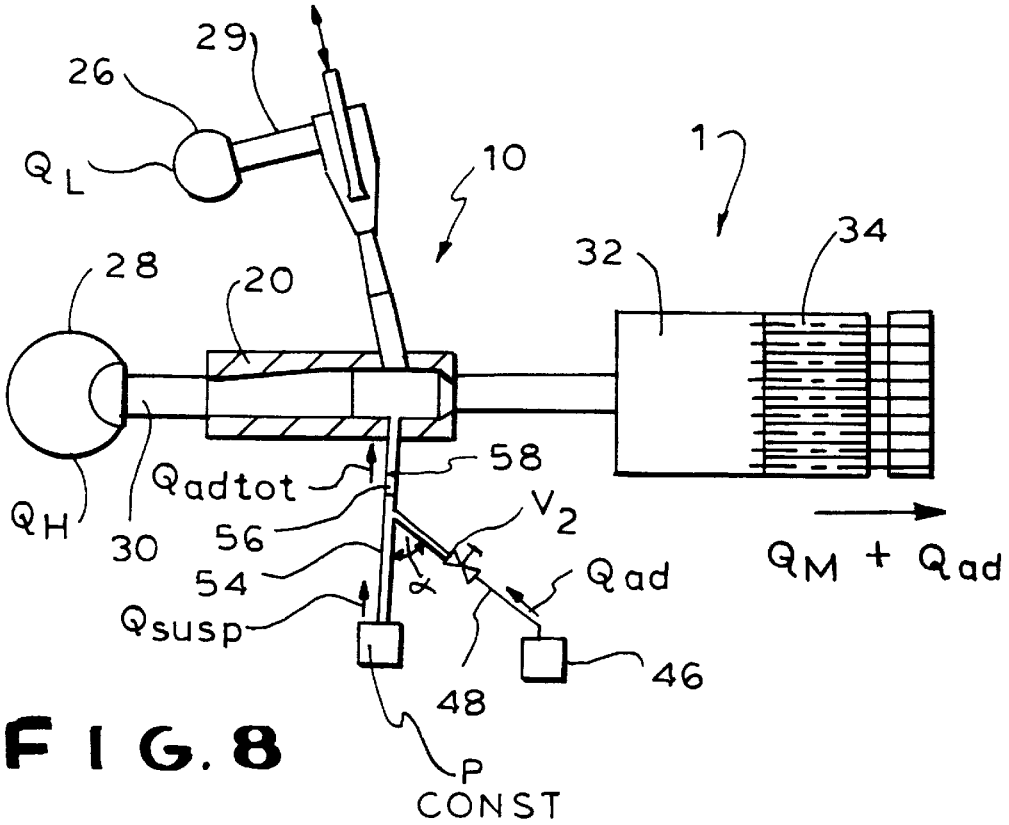
FIG. 7 is a view of the same type as FIG. 2*a* illustrating a sixth embodiment of the invention.

The embodiment of FIG. 7 substantially corresponds to the embodiment of FIG. 5, and with respect to the metering and mixing of the suspension, they are the same. In FIG. 7, the headbox has a single turbulence generator 34 as in most of the other embodiments, rather than two successive tube bundles for generating turbulence, as in the embodiment in FIG. 5.

Figure 8:
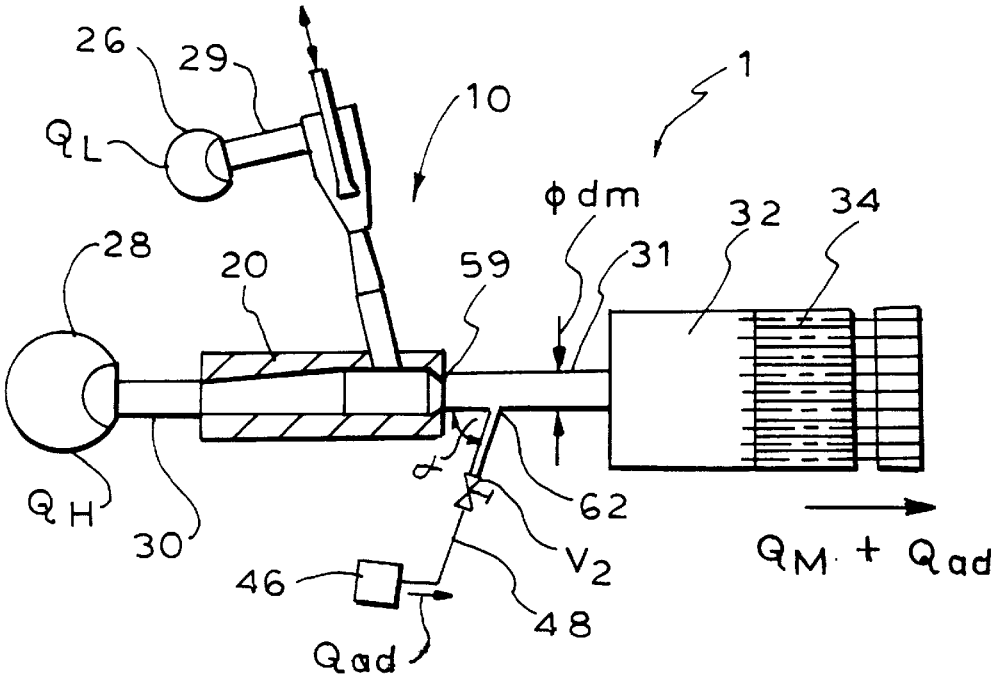
FIG. 8 is a view of the same type as FIG. 2*a* illustrating a seventh embodiment of the invention.

The embodiment of FIG. 8 has all of the features of the embodiment of FIG. 6, and those features are not repeated in detail. However, in FIG. 8, the additive metering line 48 is metered into and opens into the line 31 for sectional mixed volume flow $Q_M$ downstream of the mixer 20. The metering point 62 is located in the area of the turbulence generation zone caused by the throttle 59 in the pipe 30 following passage through the mixer 20. The distance of the metering point 62 from the throttle 59 should be a maximum of eight times the diameter $d_M$ of the pipe 31 downstream of the mixer and the metering point. Because the additives enter the pipe 31 downstream of the mixer, the dimensioning of the pipe 31 and the force with which the additives are added to that pipe and the turbulence generated at the throttle 59 are all selected to assure that the additives $Q_{ad}$ thoroughly mix with the mixed $Q_H$+$Q_L$=$Q_M$ that passed the metering point 62.

Figure 9:
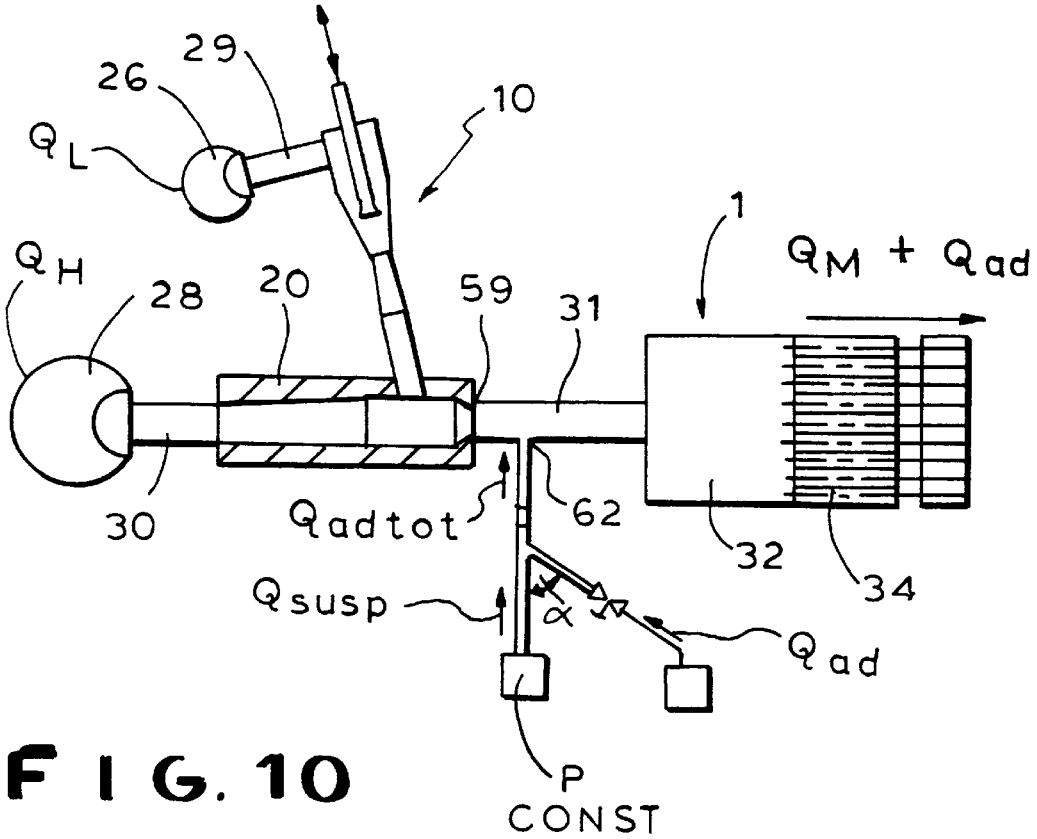
FIG. 9 is a view of the same type as FIG. 2*a* illustrating a eighth embodiment of the invention.

The embodiment of FIG. 9 is similar to that of FIG. 8 in that the metering point 62 is downstream of the throttle 59 from the mixer 20 and is in the pipe 31 downstream of the mixer 20. $Q_{ad}$ mixes with $Q_{susp}$ in an arrangement corresponding to that in FIG. 4 and described with reference to FIG. 4.

Figure 10:
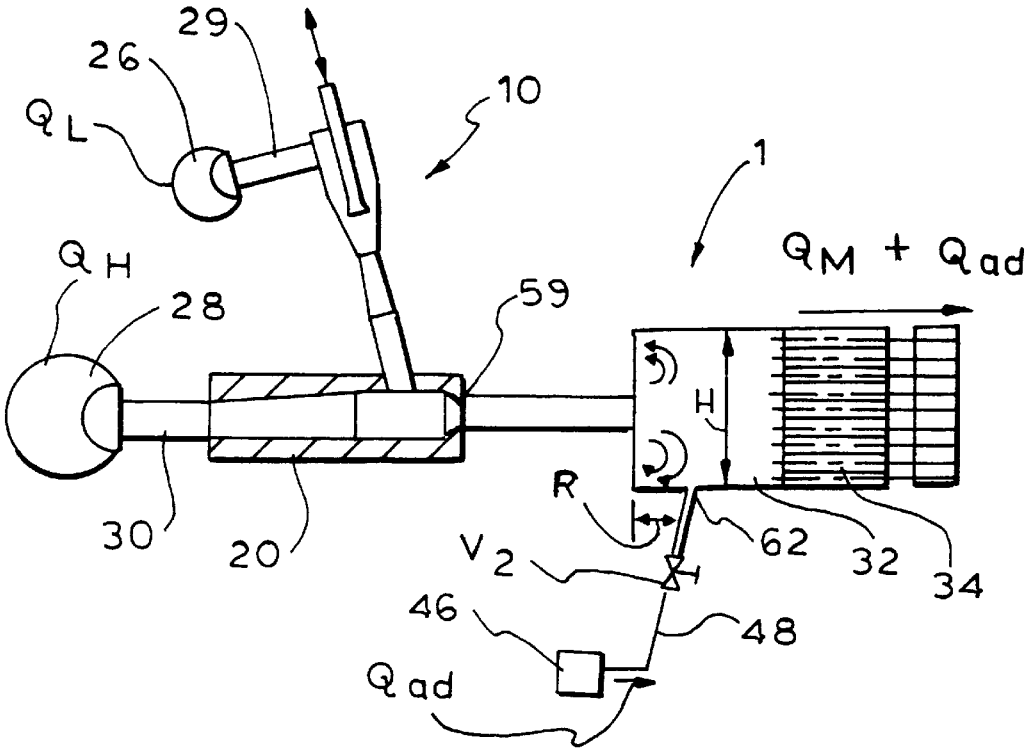
FIG. 10 is a view of the same type as FIG. 2*a* illustrating a ninth embodiment of the invention.

The embodiment of FIG. 10 generally corresponds to that of FIG. 3, except that metering takes place in the central channel or chamber 32 of the headbox 1 in the area before the microturbulence generator 34 at the entry of the mixed volume flow $Q_M$ into the central chamber 32 rather than before, or at, or after the mixer 20. To provide uniform mixing in of additives, the distance A of the metering point 62 for additives from the upstream end of the headbox 1 defines a turbulence zone where turbulence is generated by a sudden expansion from pipe 31 to channel 32 (see arrows in FIG. 10). That distance A should be less than five times the channel width, i.e. the height of the channel, H. There is sufficient turbulence within the central chamber 32 for the additives to thoroughly mix with the suspension $Q_M$ before passing through the microturbulence generator 34.

Figure 11:
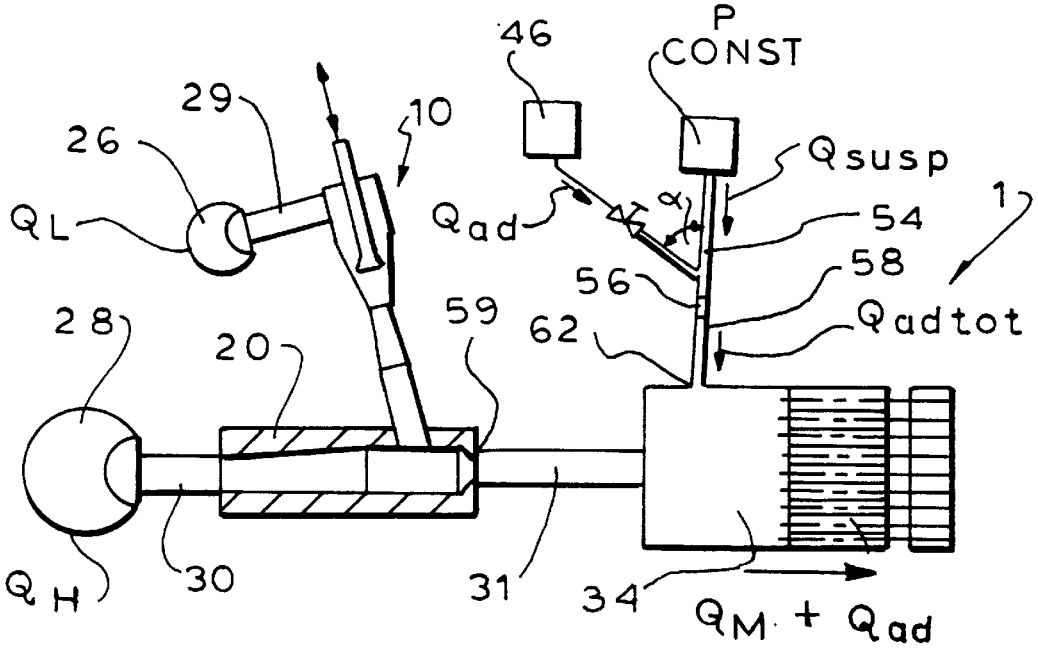
FIG. 11 is a view of the same type as FIG. 2*a* illustrating a tenth embodiment of the invention.

The embodiment of FIG. 11 is similar to that of FIG. 10 in that the additive flow $Q_{adtot}$ enters the central chamber 32 of the headbox 1. But $Q_{adtot}$ which enters the central chamber is created in the manner illustrated in FIG. 4. That the additive flow enters the central chamber from below the headbox in FIG. 10 and from above the headbox in FIG. 11 should have no effect on the final suspension flow, so long as the additive flow is thoroughly mixed in $Q_M$. Without thorough mixing, the resulting jet of suspension from the headbox outlet gap may be somewhat layered, with an uneven distribution of the additives over the height or thickness of the suspension layer.

Figure 12:
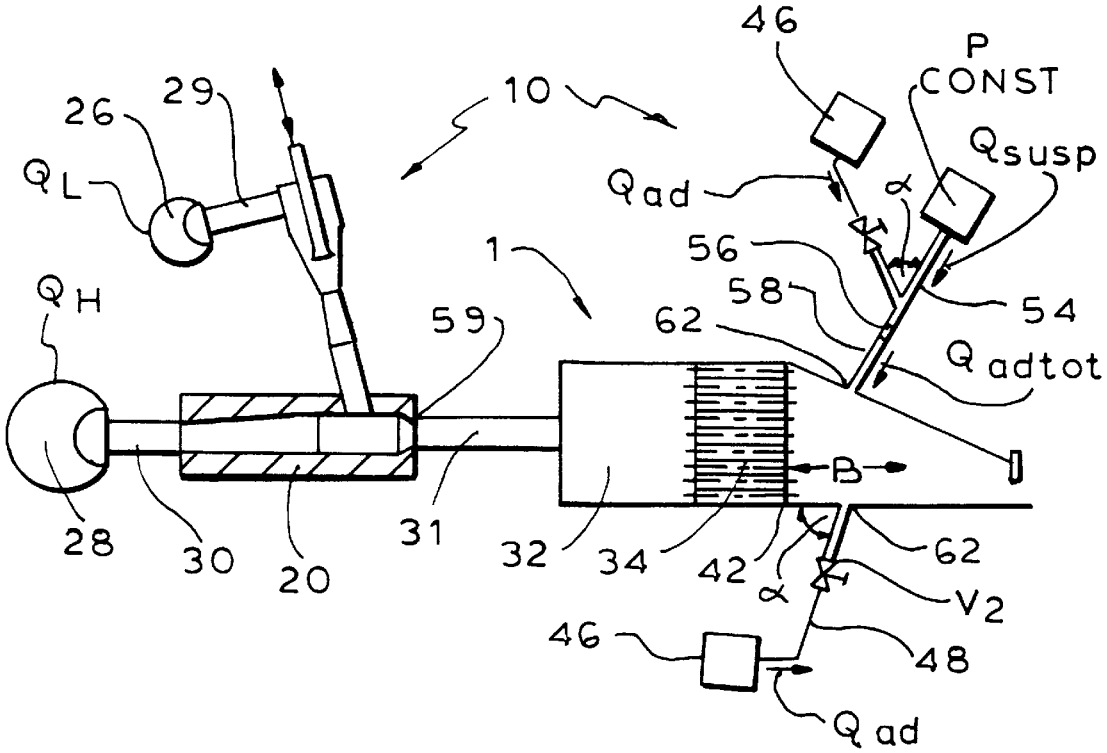
FIG. 12 is a view of the same type as FIG. 2*a* illustrating an eleventh embodiment of the invention.

The embodiment of FIG. 12 has two separate streams $Q_{adtot}$ of additives, respectively using the additive metering techniques of FIG. 3 from below and of FIG. 4 from above. It is also possible to use either metering technique D1 of FIG. 3 or D2 of FIG. 4 for metering the additives from the top and the bottom. D1 and D2 are equivalent metering arrangements. Both additive flows are delivered following the microturbulence generator 34 in the headbox 1, which is well past the mixer 20 in the path of $Q_M$. The additives must be delivered with sufficient force to mix as desired in $Q_M$ in the headbox. Because the additives are added following the turbulence generator 34, it is likely that some layering will be produced in the suspension flow out through the gap 42 of the headbox 1, with the outer layers of the suspension having a greater concentration of the additives supplied from above and below, respectively, than the central region over the height of the suspension layers. If the distance B in FIG. 12 between the metering point 62 and the downstream end 42 of the turbulence generator is less than twice the height of the turbulence generator, this can assure a smooth transition of the additives distribution in the y-direction between neighboring sections. This is due to the mixing effect of the turbulence generated in the turbulence generator, whereby the section width is at a maximum twice the height of the nozzle 40 at its upstream side.

Figure 13:
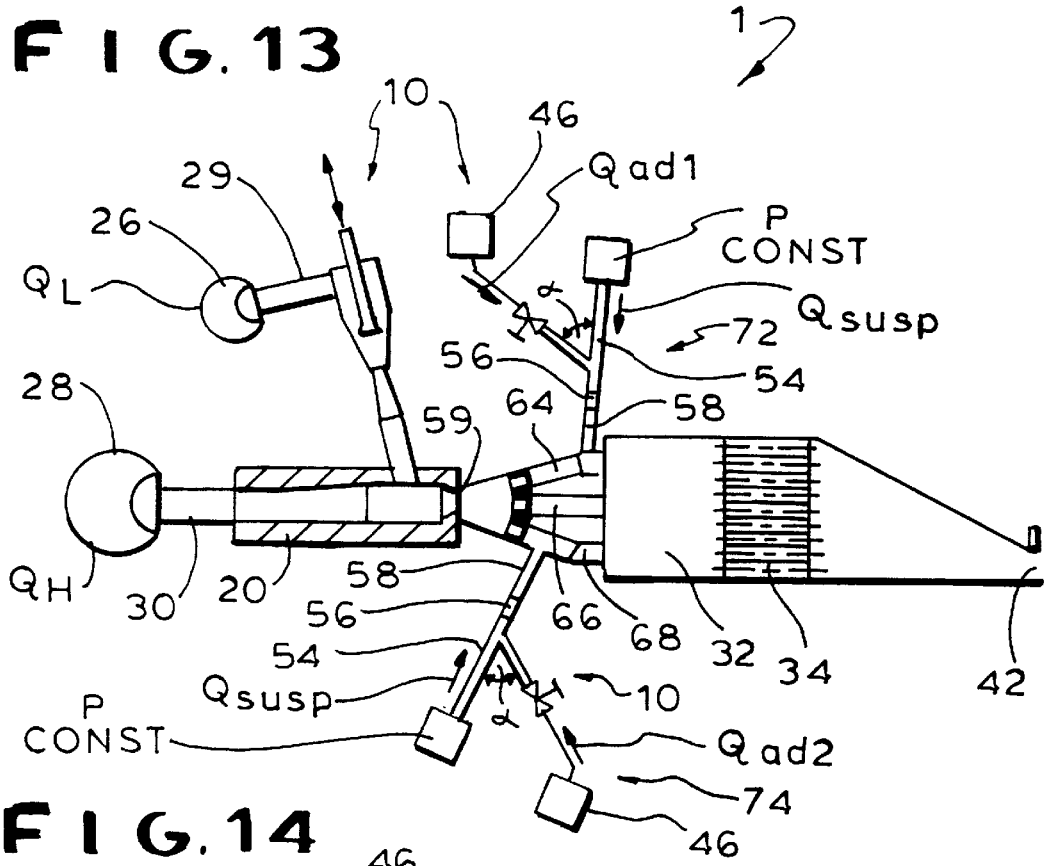
FIG. 13 is a view of the same type as FIG. 2*a* illustrating a twelfth embodiment of the invention.

FIG. 13 illustrates a single layer suspension headbox. In each section across the width of the headbox, the section flow mixing pipe 31 is replaced and is divided into three individual pipes 64, 66, 68 downstream of the mixer 20, respectively above, central and below, as viewed in the z-direction or height. There are two of the additive supply and mixing arrangements 72, 74 of FIG. 4. The first arrangement 72 is connected to the upper pipe 64 just upstream of and outside of the headbox 1. The second arrangement 74 is connected to the lower pipe 68 further upstream from the entrance to the headbox.

The metering of selected additives is into the upper and/or lower pipe 64 or 68. This enables the distribution of the additives to be additionally set in a deliberate manner over the z-direction. The suspension being delivered through the outlet gap 42 from the headbox is layered, with the top layer having a greater concentration of the additives from the arrangement 72 and the bottom layer having a greater concentration of the additives from the arrangement 74.

Figure 14:
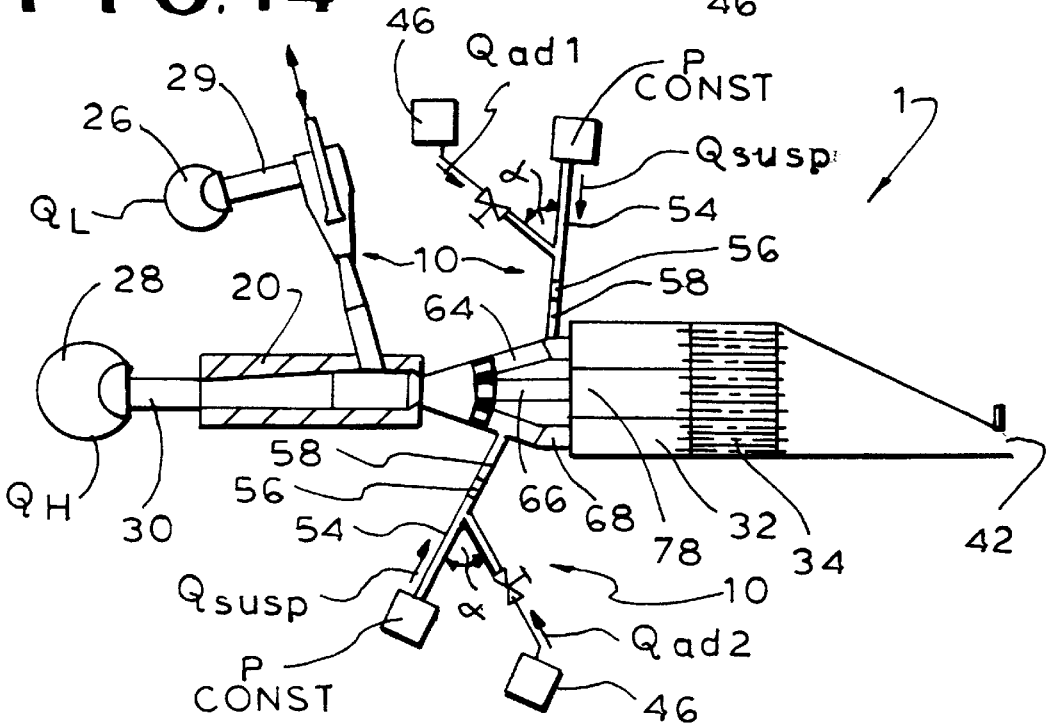
FIG. 14 is a view of the same type as FIG. 2*a* illustrating a thirteenth embodiment of the invention.

The embodiment of FIG. 14 generally corresponds to that of FIG. 13, except that the central chamber 32 before the microturbulence generator 34 has lamellae 78 which extend along the flow path entirely as far as the microturbulence insert 34 or alternately only over part of that distance. The lamellae 78 are more likely to assure a different distribution of the additives over the z-direction and are more likely to create different concentration layers of suspension at the gap 42 than the embodiment of FIG. 13.

Figure 15:
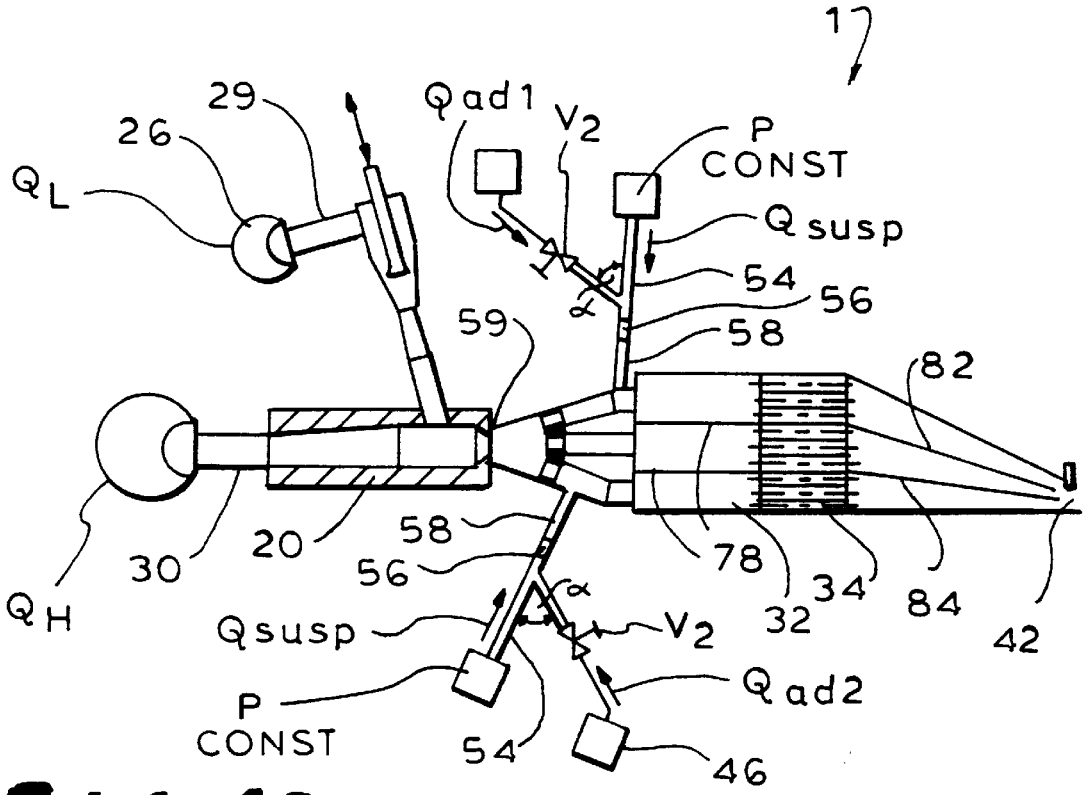
FIG. 15 is a view of the same type as FIG. 2*a* illustrating a fourteen embodiment of the invention.

The embodiment of FIG. 15, like that of FIG. 14, has lamellae 78 in the central chamber 32 upstream of the microturbulence generator 34. The mixing of additives and the creation of the suspension flow $Q_M$ at each section is done in the same way as in the embodiment of FIG. 14. In FIG. 15, the nozzle of the headbox downstream of the turbulence generator 34 likewise has lamellae 82, 84. These create layers of suspension between the adjacent lamellae and also between the outer walls of the headbox and the lamellae 82 and 84, so that the suspension exiting the gap 42 will be layered. In effect, this is a three layer box, in that the layer between adjacent lamellae and each layer between a lamella and an outer wall is different due to the different type and concentration of additives added that may be in each layer.

Figure 16:
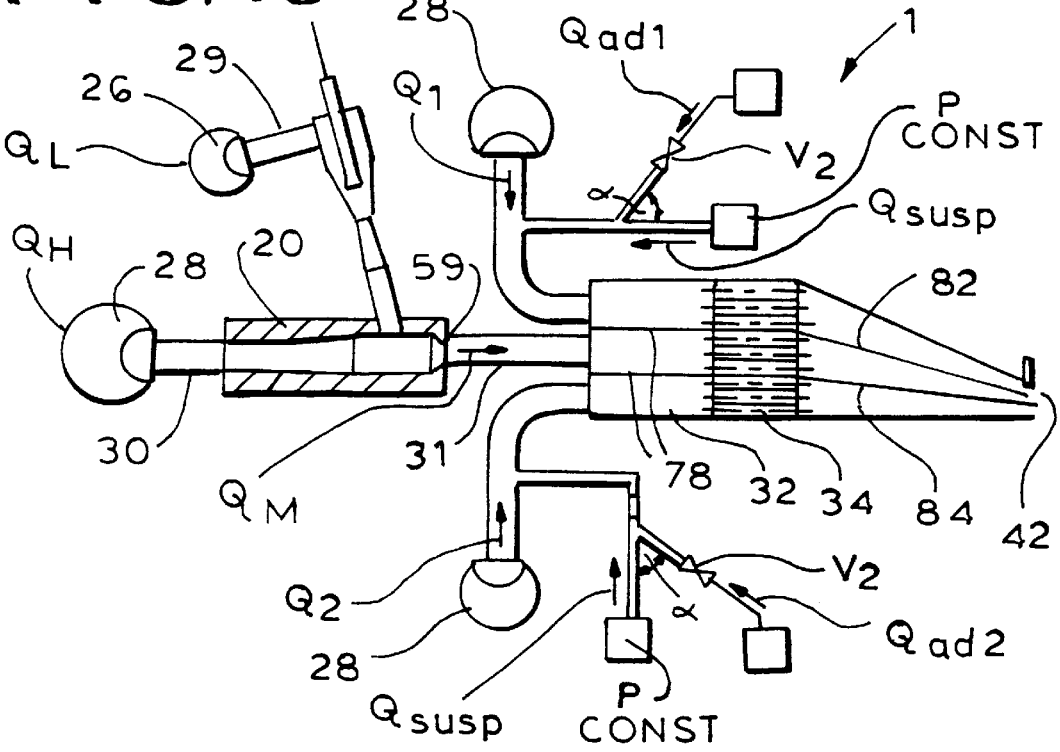
FIG. 16 is a view of the same type as FIG. 2*a* illustrating a fifteenth embodiment of the invention.

The embodiment of FIG. 16 illustrates a three layer headbox. The stock feed for the middle layer is sectioned across the lateral width of the headbox and is intended for setting the weight per unit area transverse profile in the paper web. The stock flows $Q_1$ and $Q_2$ for the outer layers are sectioned across the lateral width after the respective distribution pipes 28.

The outer, or top and bottom, or marginal layers can be charged with paper stock suspensions of a composition different from the middle layer. The headbox has the same construction as that in FIG. 15, in that there are lamellae both before 78 and after 82, 84 the turbulence generator, assuring production of three layers of suspension from the gap outlet 42 from the headbox. Each of the outer layers of the suspension is supplied with a respective mix of suspension $Q_1$ and $Q_2$, which mixture is produced in each case by a mixing and additive providing arrangement similar to that in the embodiment of FIG. 4. Both the top and bottom layers are independently supplied with their own combined flows consisting of a combination of a respective base suspension $Q_1$ and $Q_2$ and a respective additive mix $Q_{ad1}$ and $Q_{ad2}$. Metering for each of the top and bottom layers may be as in FIG. 4, although no valve V1 is illustrated for each of the top and bottom layers. However, a valve V1 might be provided as well for producing the top and bottom layers. The respective valves V2 establish the concentration of additives in each outer layer. Since the composition of each layer is independently determined, three layers can be produced and they can be quite different from each other in terms of volume and concentration of various components. The total flow volume into the headbox is composed of all flows: $Q_{HTOTAL}$, $Q_{LTOTAL}$, $Q_1$, $Q_2$, $Q_{ad1}$ and $Q_{ad2}$ through the respective pipes or lines. These flows may be flow rate controlled or pressure controlled.

Figure 17:
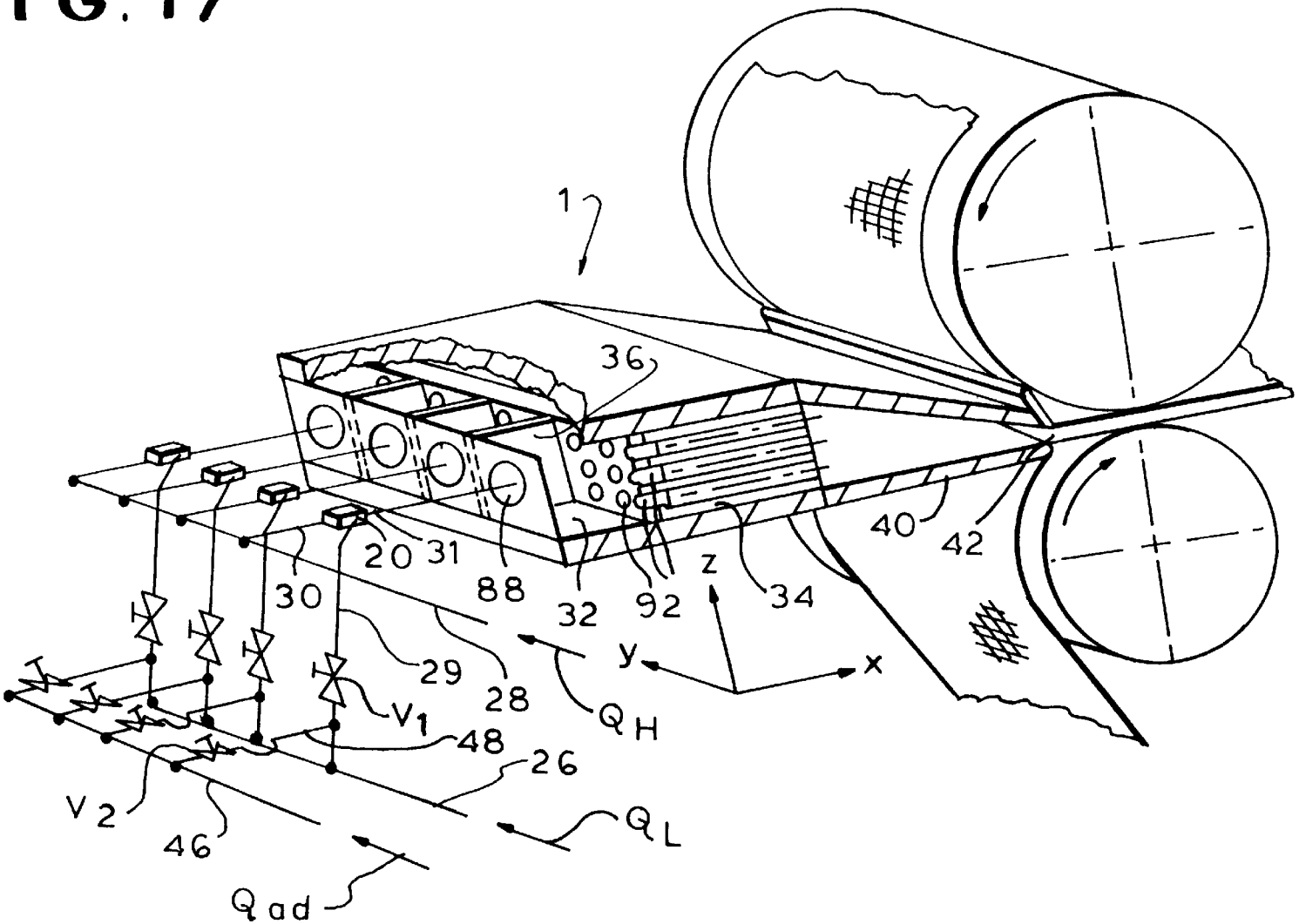
FIG. 17 is a schematic perspective view similar to FIG. 2*a* showing a sixteenth embodiment of the invention.
Figure 18:
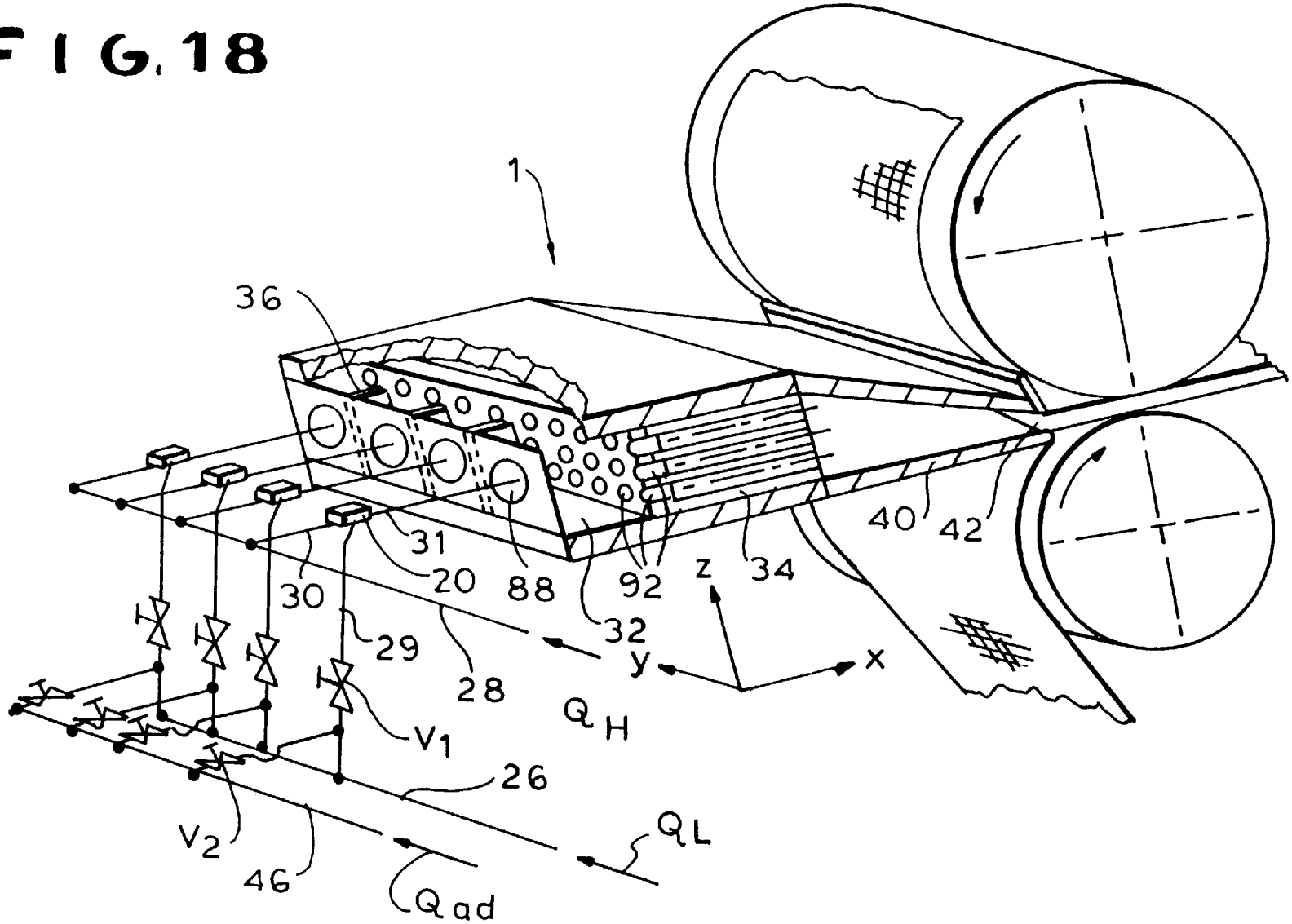
FIG. 18 is a schematic perspective view similar to FIG. 2*a* showing a seventeenth embodiment of the invention.

FIG. 17 shows a headbox embodiment like that in FIG. 2. However, the intermediate chamber 32 prior to the microturbulence generator 34 has partitions 36 that extend from the upstream wall of the headbox in the flow direction to contact the micro generator 34. Each partition 36 is between and defines adjacent sections across the width of the headbox 1, where the section has a main inlet 88 from the respective pipe 31, the intermediate chamber 32 receives that fluid and then separates the fluid into the smaller pipes 92 leading through the microturbulence generator 34.

The embodiment of FIG. 18 again corresponds to that of FIG. 2 and FIG. 17, but differs from that in FIG. 17 because the partitions 36 between adjacent sections across the width of the headbox 1 do not extend the full distance toward the microturbulence generator 34 but only part way along that distance, enabling more mixing of the suspension in adjacent sections before the suspension reaches the turbulence generator 34. However, the sectioning of the headbox nonetheless enables appropriate adjustments in the additive profile of the suspension produced in this headbox. The transition of additive distributions between neighboring sections is smoother in the embodiment of FIG. 18, in comparison with that of FIG. 17.

Figure 20:
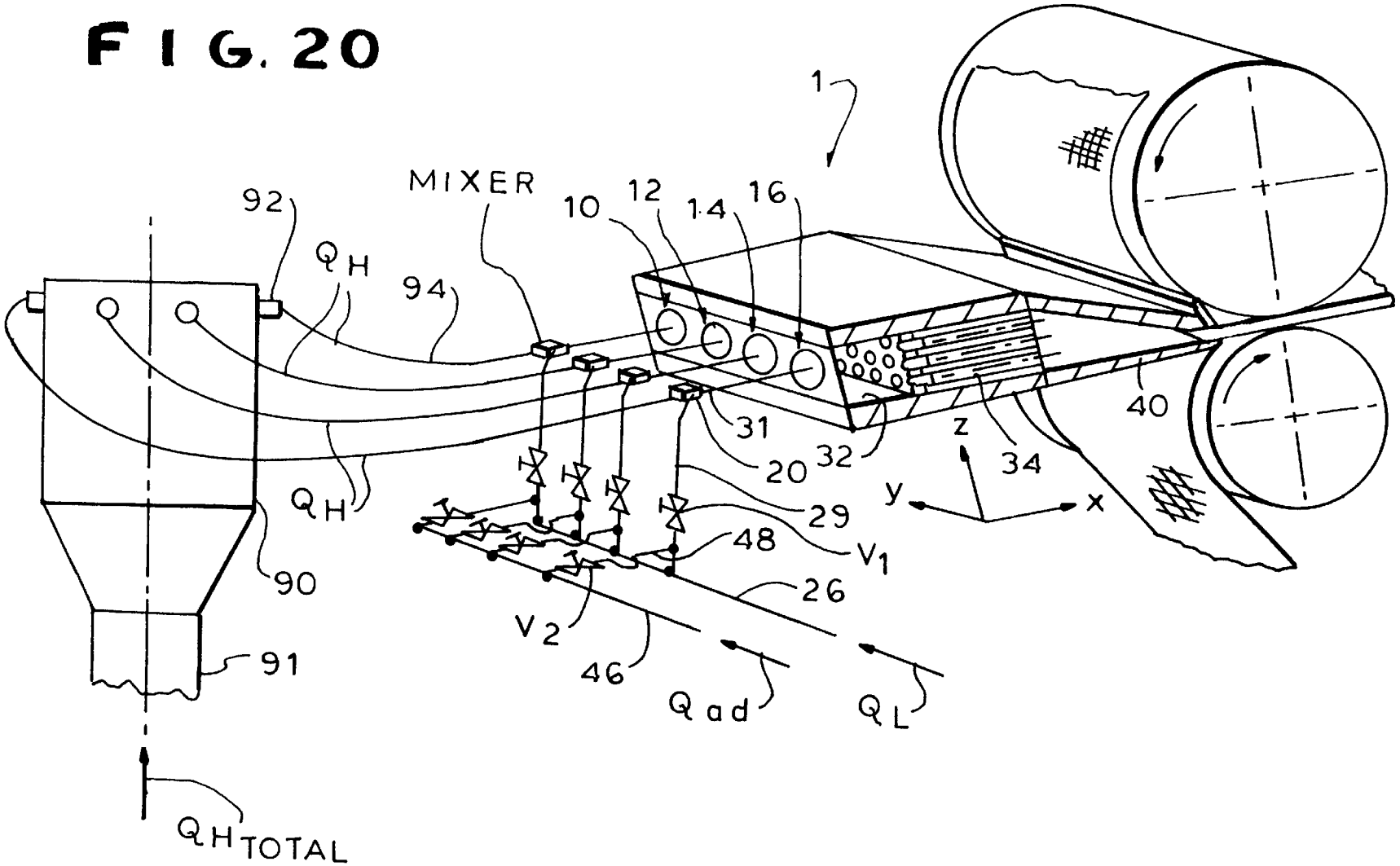
FIG. 20 shows an embodiment like that in FIG. 2 with a central distributor like that in FIG. 19.

All of the foregoing embodiments use transverse distribution pipes 26, 28 which extend across the width of the headbox. FIGS. 19 and 20 show a central distributor 90 which may be used instead of a transverse distribution pipe. The total suspension flow $Q_{HTOTAL}$ is received through the inlet 91 in the circular distributor body 90 and is then fed radially out of outlets 92 from the central distributor 90, via respective hoses or pipes 94, to each of the mixers 20 of the respective sections.

The additives supply and mixing arrangement may be inside the container of the distributor 90 or external thereof. As shown in FIG. 19*d*, the supply through each outlet 92 from the distributor 90 includes the sectional feed $Q_H$ which outlets into and through the outlet passage 92 and the pipe 94 and includes an additional respective additive supply $Q_{ad}$ through the valve 98 which also outlets into the same outlet passage 92, whereby $Q_H$ and $Q_{ad}$ are mixed in the passage 92 to come out as mixed suspension in the pipe 94. Pipe 94 leads to a respective headbox section like pipe 30 in the other embodiments.

In the alternative of FIG. 20, the additives flow $Q_{ad}$ is not into the passages 94 from the central distributor 90 for flow $Q_H$, but rather is into the pipes 48 so that as in other embodiments, like FIG. 2 or 17, $Q_{ad}$ is regulated by valves V2 and then in the sectional flows $Q_2$ by valves V1. Either form of delivery of FIGS. 19 and 20 from the central distributor 90 accomplishes the same objective.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claim is:

1. A headbox assembly for a papermaking machine for distributing pulp suspension with additives over the working width of the assembly, the headbox assembly comprising:

a headbox having an upstream end region having an upstream side with a headbox inlet for receiving the pulp suspension, the upstream end region of the headbox being comprised of a plurality of sections across the width of the headbox;

the headbox having an opposite downstream side and a discharge outlet from the downstream side of the headbox for discharging pulp suspension from the headbox for further processing;

the headbox having a turbulence generator disposed between the inlet and the discharge outlet;

means for adjusting the concentration of the pulp suspension over the width of the discharge outlet to produce a desired basis weight cross profile and a desired fiber orientation cross profile in the paper being produced by the machine, the adjusting means comprising:

for each section across the width of the headbox:

the headbox inlet being at each section and at the upstream side of the headbox;

a first supply conduit for a first stream of a first liquid $Q_H$ having a first concentration; a first connection to the inlet from the first supply conduit for introducing the first stream to the inlet at the section;

a second supply conduit for a second stream of a second liquid $Q_L$ having a second concentration; a second connection to the inlet from the second supply conduit for introducing the second stream to the inlet at the section, wherein at least one of the first and second concentrations is a pulp concentration;

sectional flow adjustment means between at least one of the first and second supply conduits for the section and the headbox inlet at the section for controlling the volume and rate of flow from the one supply conduit to the inlet, with respect to the volume and rate of flow from the others of the supply conduits at the inlet at the other respective sections, for providing mixing of the first and second streams for the section and for adjusting a ratio of the volumetric flows of the streams $Q_H$ and $Q_L$ for the section and for enabling the mixing of the first and second streams to form a respective sectional mixed stream $Q_M$ with a concentration $C_M$ which depends on the ratio of the volumetric flows of the streams $Q_H$ and $Q_L$, whereby the concentrations of the pulp suspension at the inlet at each of the sections over the width of the upstream end region of the headbox may be adjusted relative to each other;

a third supply conduit for an additive flow $Q_{ad}$ to the pulp suspension, the third supply conduit being connected so that the additive flow $Q_{ad}$ combines into the sectional mix stream $Q_M$ in the headbox upstream of the turbulence generator;

additive flow adjustment means for adjusting the volume and rate of flow of the additive flow in the third conduit; the sectional flow adjustment means for controlling the flow rate of the sectional mixed stream $Q_M$ cooperating with the additive flow adjustment means for selecting a particular concentration of pulp suspension in the sectional mixed stream $Q_M$ and a particular concentration of additives in the stream $Q_M$ while maintaining the total sectional flow of the streams $Q_H$, $Q_L$ and $Q_{ad}$ together for setting the value of the sectional mixed stream $Q_M$ with $Q_{ad}$ at a level for maintaining a selected basis weight cross profile, additive distribution and fiber orientation cross profile of the paper produced from the suspension, and wherein the only streams entering the turbulence generator are the respective sectional mixed streams $Q_M$ with $Q_{ad}$.

2. The headbox assembly of claim 1, wherein the third supply conduit is connected into the path of suspension toward the headbox inlet and with respect to the path at an angle selected for maintaining a constant flow rate of the combined additive flow and the suspension stream independent of the flow rate of the additive flow.

3. The headbox assembly of claim 1, wherein the third conduit for supply of additives is comprised of a fourth conduit for supply of a stream of additives $Q_{ad}$ and a fifth conduit for supply of a stream of suspension $Q_{susp}$ into which the additive stream $Q_{ad}$ is to be mixed, the fourth and fifth conduits combining for forming the third conduit;

the additive flow adjustment means being at the fourth conduit for the additive stream $Q_{ad}$ and controlling the volume and rate of flow of the additive stream $Q_{ad}$ that passes from the fourth conduit to mix with the suspension stream $Q_{susp}$ in the fifth conduit to together define $Q_{adtot}$ in the third conduit for supply of additives and to maintain $Q_{adtot}$ at a constant level.

4. The headbox assembly of claim 1, further comprising a common first supply of the first stream $Q_H$ to each the first supply conduits, a common second supply of the second stream $Q_L$ to each of the second supply conduits and a common third supply of additives $Q_{ad}$ to each of the third supply conduits.

5. The headbox assembly of claim 1, further comprising a common control to all of the sectional flow adjustment means of all of the sections for adjusting the concentrations of the pulp suspension flow $Q_M$ over the width of the headbox through operating the sectional flow adjustment means for maintaining the desired basis weight cross profile and fiber orientation cross profile of the paper produced from the suspension.

6. The headbox assembly of claim 1, wherein the headbox includes a microturbulence generator therein downstream of the upstream end of the headbox, the generator including small cross section flow channels therethrough in the flow direction through the headbox, through which the suspension flows for generating turbulence in the suspension.

7. The headbox assembly of claim 6, further comprising an intermediate channel defined within the headbox between the upstream end of the headbox and the microturbulence generator;

a respective separating partition within the intermediate channel and defining and separating each two adjacent ones of the sections in the intermediate channel across the width of the headbox, the partitions extending from upstream to downstream toward the microturbulence generator.

8. The headbox assembly of claim 7, wherein the partitions extend from the upstream end of the headbox toward but not all the way to the microturbulence generator.

9. The headbox assembly of claim 7, wherein the partitions extend from the upstream end of the headbox to the microturbulence generator.

10. The headbox assembly of claim 1, wherein the sectional flow adjustment means comprises a valve in at least one of the first and second conduits and the valve is selectively operable for controlling the volume and rate of flow of the respective stream in the respective conduit.

11. The headbox assembly of claim 10, wherein the additive flow adjustment means comprises a further valve in the third conduit selectively operable for controlling the volume and rate of flow of the additive flow in the third conduit.

12. The headbox assembly of claim 10, wherein the third supply conduit is connected such that the additive flow $Q_{ad}$ is mixed with the sectional flow in the conduit in which the valve is located in a region of a throttling point of the valve.

13. The headbox assembly of claim 1, further comprising a respective mixer for the first $Q_H$ and second $Q_L$ streams of liquid to each section, the mixer being located upstream in the flow path of the sectional mixed stream $Q_M$ from the inlet of the headbox, and the first and second supply conduits to each section communicating the respective streams $Q_H$ and $Q_L$ to the respective mixer.

14. The headbox assembly of claim 13, wherein the respective third supply conduit for additives communicates to the respective mixer.

15. The headbox assembly of claim 13, wherein the third supply conduit for additives communicates with the inlet to the headbox downstream in the flow path of the sectional mixed stream $Q_M$ from the mixer.

16. The headbox assembly of claim 13, wherein the third supply conduit for additives communicates into the headbox downstream in the flow path of stream $Q_M$ from the inlet to the headbox.

17. The headbox assembly of claim 16, wherein the turbulence generator is a microturbulence generator comprised of a plurality of channels spaced downstream of the upstream end of the headbox, located in the flow path through the headbox in each section and spaced downstream of the upstream end of the headbox for generating turbulence in the sectional flow $Q_M$ passing through the generator;

the third supply conduit communicating into the headbox between the upstream end of the headbox and the microturbulence generator, and the third conduit being operable to supply additive stream $Q_{ad}$ at sufficient volume and rate of flow as to mix the additive stream $Q_{ad}$ in a predetermined manner into the sectional mixed flow $Q_M$ which has entered the headbox.

18. The headbox assembly of claim 12, wherein the turbulence generator is a microturbulence generator comprised of a plurality of channels located in the flow path through the headbox and spaced downstream of the upstream end of the headbox for generating turbulence in the sectional flow $Q_M$ passing through the generator;

the third supply conduit communicating into the headbox downstream of the microturbulence generator and upstream of the outlet from the headbox, the third supply conduit being operable to supply additive stream $Q_{ad}$ with sufficient volume and rate of flow as to mix the additive stream $Q_{ad}$ in a predetermined manner into the sectional mixed flow $Q_M$ that has passed through the microturbulence generator.

19. The headbox assembly of claim 18, wherein the headbox has a top and a bottom side and the third conduit for additives communicates with the headbox at one of the top and bottom sides.

20. The headbox assembly of claim 19, further comprising a fourth conduit for supply of selected additives and communicating with the opposite one of the top and bottom sides of the headbox from the third supply conduit, the fourth conduit being for delivering selected additives to the mixed stream $Q_M$ generally from the opposite direction from which additives are supplied by the third supply conduit;

second additive flow adjustment means for adjusting the volume and rate of flow of the additives from the third and the fourth conduits into the headbox for controlling the total $Q_M$ and the total $Q_{ad}$ from the third and fourth conduits which pass through and out the outlet from the headbox.

21. The headbox assembly of claim 19, wherein the third conduit for supply of additives is comprised of a fourth conduit for supply of a stream of additives $Q_{ad}$ and a fifth conduit for supply of a stream of suspension $Q_{susp}$ into which the additive stream $Q_{ad}$ is to be mixed, the fourth and fifth conduits combining for forming the third conduit, the additive flow adjustment means being at the fourth conduit for the additive stream $Q_{ad}$ and controlling the volume and rate of flow of the additive stream $Q_{ad}$ that passes from the fourth conduit to mix with the suspension stream $Q_{susp}$ in the fifth conduit to together define $Q_{adtot}$ in the third conduit for supply of additives and to maintain $Q_{adtot}$ at a constant level.

22. The headbox assembly of claim 13, wherein the respective third supply conduit for additives communicates into one of the first and second supply conduits to each section upstream of the mixer.

23. The headbox assembly of claim 22, wherein the sectional flow adjustment means comprises a valve in at least one of the first and second conduits and the valve is selectively operable for controlling the volume and rate of flow of the respective stream in the respective conduit and the third supply conduit is connected such that the additive flow $Q_{ad}$ is mixed with the sectional flow in the conduit in which the valve is located in a region of a throttling point of the valve.

24. The headbox assembly of claim 13, further comprising a single pipe communicating from the mixer to the respective inlet to the headbox.

25. The headbox assembly of claim 13, further comprising a plurality of suspension transmitting pipes communicating between the mixer and the inlet to the headbox, the pipes including an upper pipe communicating into the headbox more toward the top of the headbox, a lower pipe communicating into the headbox more toward the bottom of the headbox and a middle pipe communicating into the headbox between the top and bottom pipes;

the third conduit for supply of additives communicating into at least one of the top and bottom pipes leading to the inlet of the headbox.

26. The headbox assembly of claim 25, wherein at least one of the plurality of pipes includes a throttle.

27. The headbox assembly of claim 25, wherein each of the pipes includes a throttle.

28. The headbox assembly of claim 25, wherein the third conduit is connected to one of the pipes at a location close to the throttle thereof.

29. The headbox assembly of claim 13, further comprising a fourth supply conduit for supply of selected additives separate from the third supply conduit and the fourth conduit for supply of additives communicating with the other of the top and bottom pipes leading to the inlet of the headbox;

second additive flow adjustment means for adjusting the volume and rate of flow of the additives from the third and the fourth conduits into the headbox for controlling the total $Q_M$ and the total $Q_{ad}$ from the third and fourth conduits which pass through and out the outlet from the headbox.

30. The headbox assembly of claim 29, further comprising lamellae extending from the upstream end of the headbox toward the downstream end of the headbox and in each section separating the inlet flows into the headbox by separating the inlet flow from the top and middle pipes and separating the inlet flows from the middle and bottom pipes.

31. The headbox assembly of claim 30, further comprising a microturbulence generator in the headbox at each section downstream from the upstream end of the headbox, the generator comprising a plurality of small cross section channels therethrough in the flow direction through the headbox for generating turbulence in the suspension passing through the generator; and the lamellae extending from the upstream end of the headbox toward the microturbulence generator.

32. The headbox assembly of claim 31, further comprising additional lamellae extending from the microturbulence generator toward the outlet from the headbox, with each of the additional lamellae being substantially aligned with one of the lamellae extending from the upstream end of the headbox such that the separation of flows caused by the lamellae at the upstream end of the headbox is continued downstream of the microturbulence generator by the additional lamellae.

33. The headbox assembly of claim 13, wherein the third conduit for supply of additives communicates to the inlet of the headbox downstream of the mixer, a pipe from the mixer to the inlet to the headbox;

a throttle at the mixer leading into the pipe for increasing turbulence of the suspension leaving the mixer and entering the pipe.

34. The headbox assembly of claim 13, further comprising the mixer having an outlet for suspension toward the inlet of the headbox and the outlet from the mixer including a throttle for the suspension passing through the-mixer to increase the turbulence in the suspension passing the throttle.

35. A method for providing a selected basis weight cross profile, a selected fiber orientation cross profile and a selected distribution of additives in paper produced from a supply of pulp suspension that passes through a headbox for further processing following the headbox, wherein the headbox includes an inlet to the upstream end of the headbox, a plurality of separate suspension supply sections distributed along the width of the headbox and to supply suspension to the headbox inlet at each of the sections, the method comprising:

supplying a first partial stream of liquid $Q_H$ and a second partial stream of liquid $Q_L$ to the headbox inlet at each of the sections to form a combined flow stream $Q_M$ for the section, wherein at least one of the first and second partial streams to the inlet at a section includes pulp suspension such that each section is supplied with the respective combined stream $Q_M$ including pulp suspension;

selectively controlling the volume per unit time of at least one of the first $Q_H$ and second $Q_L$ partial streams to each section for controlling the volume per unit time and rate of flow of the combined stream $Q_M$ to the inlet of the headbox at each section for controlling at least one of the basis weight cross profile and the fiber orientation cross profile of the paper produced from a machine including the headbox;

supplying a respective third stream of additives $Q_{ad}$ to the inlet to the headbox at each section and selectively controlling the volume per unit time and the rate of flow of the third stream $Q_{ad}$ additives into the combined partial streams $Q_M$ for selectively affecting the distribution of additives in the paper produced from a machine including the headbox through acting on the total volume and rate of flow of suspension $Q_M$ and additives $Q_{ad}$ and the concentration $C_M$ of $Q_M$ entering the inlet to the headbox at the section of the headbox.

36. The method of claim 35, further comprising coordinating the total volume per unit time and rate of flow of the combined first and second partial streams and the third stream of additives at each section for achieving a selected basis weight cross profile, a selected additive distribution and a selected fiber orientation cross profile of the paper produced from a machine including the headbox.

37. The method of claim 36, further comprising selectively controlling the volume per unit time and rate of flow of either of the suspension flows $Q_H$ and $Q_L$ and the volume per unit time and rate of flow of additives $Q_{ad}$ for selectively increasing or decreasing the total flow of suspension and additives into the headbox for the respective section of the headbox.

38. The method of claim 36, further comprising supplying each of the first partial streams to the sections of the headbox through a first common supply, supplying each of the second partial streams to the sections of the headbox through a second common supply and supplying each of the third stream of additives to the sections of the headbox through a third common supply, and controlling the volume per unit time and rate of flow of each of the first and second partial streams and of the third stream of additives to each section at locations in the flow path between the respective common supplies and the inlet to the headbox at each section.

39. The method of claim 35, further comprising adding the third supply of additives to the first partial stream before the first partial stream is mixed with the second partial stream.

40. The method of claim 35, further comprising mixing the third stream of additives together with the first and second partial streams.

41. The method of claim 35, further comprising adding the third stream of additives to the mixed first and second partial streams.

42. The method of claim 35, further comprising adding the third stream of additives into the headbox to the mixed first and second partial streams.

43. The method of claim 35, wherein the step of selectively controlling the volume per unit time and the velocity of at least one of first $Q_M$ and second $Q_L$ partial streams includes passing at least one of the first $Q_M$ and second $Q_L$ partial streams through a valve and selectively adjusting the valve.

44. The method of claim 43, wherein the third supply conduit is connected such that the additive flow $Q_{ad}$ is mixed with the sectional flow in the conduit in which the valve is located in a region of a throttling point of the value.

45. The method of claim 35, wherein the combined stream is supplied to each section through a plurality of suspension transmitting pipes, the pipes including an upper pipe communicating into the headbox more toward the top of the headbox, a lower pipe communicating into the headbox more toward the bottom of the headbox and a middle pipe communicating into the headbox between the top and bottom pipes and the respective third stream is supplied to the inlet through a third conduit for supply of additives communicating into at least one of the top and bottom pipes leading to the inlet of the headbox.

46. The method of claim 45, wherein each of the pipes includes a throttle.

47. The method of claim 46, wherein the third conduit is connected to one of the pipes at a location close to the throttle thereof.

48. The method of claim 45, wherein the at least one of the plurality of pipes includes a throttle.

49. A headbox assembly for a papermaking machine for distributing pulp suspension with additives over the working width of the assembly, the headbox assembly comprising:

a headbox having an upstream end region having an upstream side with a headbox inlet for receiving the pulp suspension, the upstream end region of the headbox being comprised of a plurality of sections across the width of the headbox;

the headbox having an opposite downstream side and a discharge outlet from the downstream side of the headbox for discharging pulp suspension from the headbox for further processing;

the headbox having a turbulence generator disposed between the inlet and the discharge outlet and a nozzle disposed between the turbulence generator and the discharge outlet;

means for adjusting the concentration of the pulp suspension over the width of the discharge outlet to produce a desired basis weight cross profile and a desired fiber orientation cross profile in the paper being produced by the machine, the adjusting means comprising:

for each section across the width of the headbox:

the headbox inlet being at each section and at the upstream side of the headbox;

a first supply conduit for a first stream of a first liquid $Q_H$ having a first concentration; a first connection to the inlet from the first supply conduit for introducing the first stream to the inlet at the section;

a second supply conduit for a second stream of a second liquid $Q_L$ having a second concentration; a second connection to the inlet from the second supply conduit for introducing the second stream to the inlet at the section, wherein at least one of the first and second concentrations is a pulp concentration;

sectional flow adjustment means between at least one of the first and second supply conduits for the section and the headbox inlet at the section for controlling the volume and rate of flow from the one supply conduit to the inlet, with respect to the volume and rate of flow from the others of the supply conduits at the inlet at the other respective sections, for providing mixing of the first and second streams for the section and for adjusting a ratio of the volumetric flows of the streams $Q_H$ and $Q_L$ for the section and for enabling the mixing of the first and second streams to form a respective sectional mixed stream $Q_M$ with a concentration $C_M$ which depends on the ratio of the volumetric flows of the streams $Q_H$ and $Q_L$, whereby the concentrations of the pulp suspension at the inlet at each of the sections over the width of the upstream end region of the headbox may be adjusted relative to each other;

a third supply conduit for an additive flow $Q_{adtot}$ to the pulp suspension, the third supply conduit being connected so that the additive flow $Q_{adtot}$ combines into the sectional mix stream $Q_M$ in the nozzle, the third conduit for supply of additives being comprised of a fourth conduit for supply of a stream of additives $Q_{ad}$ and a fifth conduit for supply of a stream of suspension $Q_{susp}$ into which the additive stream $Q_{ad}$ is to be mixed, the mixed streams defining $Q_{adtot}$ the fourth and fifth conduits combining for forming the third conduit;

additive flow adjustment means for adjusting the volume and rate of flow of the additive flow in the third conduit; the sectional flow adjustment means for controlling the flow rate of the sectional mixed stream $Q_M$ cooperating with the additive flow adjustment means for selecting a particular concentration of pulp suspension in the sectional mixed stream $Q_M$ and a particular concentration of additives in the stream $Q_M$ while maintaining the total sectional flow of the streams $Q_H$, $Q_L$ and $Q_{adtot}$ together for setting the value of the sectional mixed stream $Q_M$ with $Q_{adtot}$ at a level for maintaining a selected basis weight cross profile and fiber orientation cross profile of the paper produced from the suspension, the additive flow adjustment means being at the fourth conduit for the additive stream $Q_{ad}$ and controlling the volume and rate of flow of the additive stream $Q_{ad}$ that passes from the fourth conduit to mix with the suspension stream $Q_{susp}$ in the fifth conduit to maintain $Q_{adtot}$ at a constant level.

* * * * *